US011987938B2

(12) United States Patent
Locke et al.

(10) Patent No.: US 11,987,938 B2
(45) Date of Patent: May 21, 2024

(54) DRAINAGE DEVICE AND METHODS FOR CONSTRUCTING AND USE

(71) Applicant: ABT, INC., Troutman, NC (US)

(72) Inventors: Blake Locke, Houston, TX (US); Tim Wallace, Troutman, NC (US); Tom Simon, Statesville, NC (US); Charles Gunter, Mooresville, NC (US)

(73) Assignee: ABT, Inc., Troutman, NC (US)

( * ) Notice: Subject to any disclaimer, the term of this patent is extended or adjusted under 35 U.S.C. 154(b) by 474 days.

(21) Appl. No.: 16/621,962

(22) PCT Filed: Jun. 12, 2018

(86) PCT No.: PCT/US2018/037138
§ 371 (c)(1),
(2) Date: Dec. 12, 2019

(87) PCT Pub. No.: WO2018/231852
PCT Pub. Date: Dec. 20, 2018

(65) Prior Publication Data

US 2020/0190747 A1 Jun. 18, 2020

Related U.S. Application Data

(60) Provisional application No. 62/545,104, filed on Aug. 14, 2017, provisional application No. 62/545,112, filed on Aug. 14, 2017, provisional application No. 62/518,427, filed on Jun. 12, 2017.

(51) Int. Cl.

| | |
|---|---|
| ***E01C 11/22*** | (2006.01) |
| ***E01D 19/08*** | (2006.01) |
| ***E03F 5/04*** | (2006.01) |

(52) U.S. Cl.
CPC ..... *E01C 11/227* (2013.01); *E01D 19/086* (2013.01); *E03F 5/04* (2013.01)

(58) Field of Classification Search
CPC ..... E01C 11/227; E01D 19/086; E03F 5/04
See application file for complete search history.

(56) References Cited

U.S. PATENT DOCUMENTS

| | | | |
|---|---|---|---|
| 2,780,150 | A | 2/1957 | Yeoman |
| 4,522,531 | A | 6/1985 | Thomsen et al. |

(Continued)

FOREIGN PATENT DOCUMENTS

| | | | |
|---|---|---|---|
| DE | 2844748 | A1 | 4/1979 |
| FR | 2967428 | A1 | 5/2012 |

(Continued)

OTHER PUBLICATIONS

Office Action issued by the Canadian Patent Office for Canadian Patent Application No. 3,067,215, dated Mar. 15, 2021.

(Continued)

*Primary Examiner* — Abigail A Risic
(74) *Attorney, Agent, or Firm* — Bradley Arant Boult Cummings, LLP; Henry B. Ward, III

(57) ABSTRACT

The present invention is manufactured to prevent the difficulties that may arise when installing a drainage system into a trench that has been cut into a sidewall of a building containing a network of structural members. The present invention is developed to produce a secure and effective connection between the structural member(s) of a drainage system and the structural members in the sidewall of a building in order to increase the stability of the drainage system within the sidewall.

15 Claims, 15 Drawing Sheets

(56) References Cited

U.S. PATENT DOCUMENTS

| | | | | |
|---|---|---|---|---|
| 4,815,888 | A | 3/1989 | Stegmeier | |
| 5,281,051 | A * | 1/1994 | Stegall | E01C 19/506 405/118 |
| 6,443,656 | B1 * | 9/2002 | Gunter | E01C 19/506 403/324 |
| 8,240,946 | B2 | 8/2012 | Applefield | |
| 2016/0362883 | A1 | 12/2016 | Simon et al. | |
| 2017/0175374 | A1 * | 6/2017 | Funari | E01C 11/227 |
| 2020/0123725 | A1 * | 4/2020 | Adams | B65D 88/1625 |

FOREIGN PATENT DOCUMENTS

| | | | |
|---|---|---|---|
| JP | 2013185361 | A | 9/2013 |
| KR | 20060102831 | A | 9/2006 |
| KR | 100770164 | B1 | 10/2007 |
| WO | 2015013682 | A2 | 1/2015 |

OTHER PUBLICATIONS

Examination Search Report issued by the Canadian Patent Office for Canadian Patent Application No. 3,067,215, dated Feb. 17, 2021.

Office Action issued by the Canadian Patent Office for Canadian Patent Application No. 3,067,215, dated Oct. 19, 2021.

Examination Search Report issued by the Canadian Patent Office for Canadian Patent Application No. 3,067,215, dated Oct. 10, 2021.

Extended Search Report issued by the European Patent Office for European Patent Application No. 18818123, dated Nov. 25, 2020.

International Preliminary Report on Patentability from the International Bureau for corresponding International Patent Application No. PCT/US2018/037138, dated Dec. 17, 2019, 11 pages.

International Search Report issued by the U.S. Patent and Trademark Office for International Application No. PCT/US2018/037138, dated Aug. 31, 2018.

Written Opinion issued by the U.S Patent and Trademark Office for International Application No. PCT/US2018/037138, dated Aug. 31, 2018.

Office Action issued by the Canadian Patent Office for Canadian Patent Application No. 3,067,215, dated Oct. 21, 2022.

Examination Search Report issued by the Canadian Patent Office for Canadian Patent Application No. 3,067,215, dated Sep. 30, 2022.

Office Action issued by the Mexican Patent Office for Mexican Patent Application No. MX/a/2019/014987, dated Jul. 6, 2023.

Office Action issued by the Mexican Patent Office for Mexican Patent Application No. MX/a/2019/014987, dated Dec. 11, 2023.

* cited by examiner

DRAINAGE DEVICE AND METHODS FOR CONSTRUCTING AND USE

CROSS-REFERENCE TO RELATED APPLICATIONS

This application claims priority to U.S. Provisional Application No. 62/518,427, entitled "DRAINAGE DEVICE AND METHODS FOR CONSTRUCTING AND USE," filed Jun. 12, 2017, U.S. Provisional Application No. 62/545,104, entitled "STRUCTURALLY REINFORCED DRAINAGE AND METHODS OF MANUFACTURE AND INSTALLATION," filed Aug. 14, 2017, and U.S. Provisional Application No. 62/545,112, entitled "STRUCTURALLY REINFORCED DRAINAGE AND METHODS OF MANUFACTURE AND INSTALLATION," filed Aug. 14, 2017. All three of the foregoing provisional applications are incorporated herein by reference in their entireties.

FIELD

The invention relates generally to drainage systems and, more particularly, relates to methods of manufacture and installation of a drainage system having an open-faced channel and at least one structural member for reinforcement.

BACKGROUND

Drainage systems comprising channels and trenches of various sizes and shapes are desirable for a number of applications. For example, manufacturing facilities typically require drainage systems that include trenches formed in the building floors to collect, remove, and/or recycle excess water or other liquids. These trenches may also be used as utility chases to provide temporary or permanent routing of electrical lines, pipes, conduits or the like below the level of the building floor. In addition, numerous outdoor industrial and commercial sites, such as parking lots and airports, also require drainage systems to collect and direct rainwater and other liquids to underground storm sewers to prevent flooding and to decrease run-off. Likewise, buildings with flat or built-up roofs typically require drainage systems, including scuppers, formed in the sidewalls or roofs of the buildings to collect, direct, and prevent pooling of rainwater on the roofs of the buildings. Additionally, roadways, bridges, and the like may also require drainage systems, including trenches and scuppers.

A scupper is a drainage system that includes a trench cut into a sidewall of an open-air structure (e.g., a bridge or elevated roadway) for the purpose of draining water off the side of the structure, rather than allowing the water to create a pool within the sidewall(s). In the past, scuppers have generally been formed by first cutting a trench into an existing sidewall of an open-air structure and then placing and securing a precast, open-faced channel, which may have one or more channel sections, in the trench. A moldable composition, such as cementitious material, is then poured around the open-faced channel and allowed to set. In particular, the open-faced channel may be supported on a plurality of downwardly extending legs which are positioned on the surface at the bottom of the trench. If the open-faced channel has more than one channel section, pouring a subslab may be necessary to prevent the buoyancy of the channel sections in the wet concrete from causing the sections to float out of position and become misaligned. To form a subslab, a first pour of concrete is made to a level below the open-faced channel and allowed to harden. A second pour of concrete is then applied over the subslab up to the upper edges of the open-faced channel to fully embed the channel. Current designs limit the size of the components of the scupper to have minimum disruption of the panel reinforcement (i.e., concrete and rebar infrastructure of the open-air structure) or making the whole scupper sufficiently strong to transfer the structural loads around the panel penetration.

Once the concrete has set, it is normally desirable to finish the drainage channel with a trench cover, such as an elongate grate covering its open top, in order to prevent people from unwittingly stepping in the open trench, to provide a smooth surface, and/or to prevent relatively large objects from entering the trench and potentially blocking the flow of liquid therethrough. The trench cover is typically removable and supported by a support surface defined longitudinally along an inner portion of each opposed wall of the open-faced channel.

Scuppers are especially useful in draining parapet walls on flat or built-up roofs of buildings. A parapet is an extension of the sidewall at the edge of an open-air structure, such as a roof, terrace, balcony, or bridge. On certain open-air structures, parapet walls contain a continuous, internal network of structural members for reinforcement of the parapets. Difficulties may arise, however, when a trench must be cut into a parapet wall that contains a network of structural members in order to install a scupper. Unfortunately, cutting into a network of structural members inside a parapet wall creates a weak point in the sidewall that may cause a parapet to break off and detach from the open-air structure.

Traditionally, parapet walls were used as a defense against attack, shielding soldiers and warriors standing on top of open-air structures from arrows and projectiles shot or catapulted into the air. However, today, parapet walls are primarily used as guard rails, protecting people and objects from falling off the side of open-air structures. As such, it is of great importance to maintain the continuous, internal network of structural members for reinforcement when installing drainage systems into parapet walls.

BRIEF SUMMARY OF EMBODIMENTS OF THE INVENTION

The following is a brief summary of the invention and is not intended to limit the scope of the invention.

The present invention is manufactured to prevent the difficulties that may arise when installing a drainage system into a trench that has been cut into a sidewall of a building containing a network of structural members. The present invention is developed to produce a secure and effective connection between the structural member(s) of a drainage system and the structural members in the sidewall of a building in order to increase the stability of the drainage system within the sidewall.

In accordance with some embodiments, a drainage system having an open-faced channel, preferably precast, is provided. The drainage system may be structured to be fixedly embedded within a curable medium or pourable composition, such as concrete, which may have a structural support comprising a plurality of structural members. The drainage system may comprise a first and second lateral side and a first and second end member or, collectively, four sidewalls. The first end member is attached to one end of the first and second lateral sides, the second end member is attached to the opposing end of the first and second lateral sides, and the first and second lateral sides and the first and second end members are spaced apart by a predetermined distance to define an interior space therebetween. Preferably, the four sidewalls are connected to a bottom wall which is attached to a bottom end of the first and second lateral sides and a bottom end of the first and second end members.

At least one of said first lateral side, second lateral side, first end member, and second end member may define an aperture therethrough structured to receive one of the plurality of structural members to thereby tie the drainage system into the structural support for the curable medium. In some embodiments, at least one of said first lateral side, second lateral side, first end member, and second end member may define an aperture therethrough structured to matingly engage one of the plurality of structural members to thereby tie the drainage system into the structural support for the curable medium. In some embodiments, a different one of said first lateral side, second lateral side, first end member, and second end member may define an additional aperture structured to matingly engage the one of the plurality of structural members.

Each sidewall of the open-faced channel preferably includes at least one anchor flange extending along its length to anchor the drainage system within the curable medium or moldable composition poured around the open-faced channel. The anchor flanges are preferably continuous and integrally formed in the sidewalls.

The drainage system may be configured to be attached to at least one structural member and, preferably, a network of structural members. The structural member(s) are preferably formed of stainless steel, galvanized, or coated on the exterior with a water-resistant substance. The first end of at least one structural member may extend through an aperture in at least one of the sidewalls of the open-faced channel. In some embodiments, the second end of the structural member may extend through an aperture in at least a different one of the sidewalls of the open-faced channel. The first and second ends of a structural member are adapted to connect to the ends of structural members located within the sidewall of a trench and are preferably permanently attached to the apertures in the sidewalls of the open-faced channel.

The open-faced channel further includes an upper side edge that preferably includes a support surface for supporting a trench cover, such as a grate or a plate. In such embodiments, the support surface may be defined longitudinally by an upper side edge of the first lateral side and an upper side edge of the second lateral side. According to one advantageous embodiment, the trench cover is formed of a metal, merely set upon the support surface, and held in place by gravity, without utilizing any additional hardware to attach the trench cover to the open-faced channel. Such an embodiment allows the trench cover to be readily removed in order to access the trench, such as to clean the trench or remove some object from the trench. In another embodiment, the trench cover can be secured in place via retention members extending through the sidewalls, which can be inserted and removed as necessary to secure and remove the trench cover, respectively.

Additionally, the drainage system preferably includes a conduit connector capable of interconnecting various drainage system components, such as a conduit and a downspout. According to one advantageous embodiment, the conduit connector is embedded within the bottom wall of the open-faced channel such that the conduit connector does not protrude substantially beyond the inner and outer surfaces of the wall. In some embodiments, the bottom wall may be slanted at an angle toward the conduit connector.

In some embodiments, the drainage system may further comprise a stationary retention pin placed within a first hole in at least one of the first and second lateral sides and the first and second end members, wherein the stationary retention pin is configured to retain a first integrally-formed lug of the trench cover. The drainage system may further comprise a removable retention pin placed within a second hole in at least one of the first and second lateral sides and the first and second end members, wherein the removable retention pin creates a space between the removable retention pin and a second integrally-formed lug of the trench cover, wherein the drainage system further comprises a removable plate configured to occupy the space between the removable retention pin and the second integrally-formed lug of the trench cover to facilitate retention of the trench cover.

In some embodiments, the open-faced channel may further comprise one or more installation legs that are removably attached to the open-faced channel, where the installation legs are configured to secure the open-faced channel within the curable medium or moldable composition.

The present invention also provides a method of manufacture and installation of a drainage system having an open-faced channel and at least one structural member for reinforcement. The method of installation comprises providing an open-faced channel having a first and second lateral side and a first and second end member, wherein the first end member is attached to one end of the first and second lateral sides, the second end member is attached to the opposing end of the first and second lateral sides, and the first and second lateral sides and the first and second end members are spaced apart by a predetermined distance to define an interior space therebetween. The method may further comprise providing at least one structural member having a first and second end, wherein the first end of a structural member extends through an aperture in at least one of the first and second end members or the first and second lateral sides, positioning the drainage system in a trench, wherein the trench comprises at least two sidewalls that each contain at least one structural member having an end, and securing the first end of a structural member of the drainage system to an end of a structural member in a sidewall of the trench.

In some embodiments, the second end of the structural member of the drainage system may extend through an aperture in at least a different one of the first and second end members or the first and second lateral sides. In such embodiments, the method may further comprise securing the second end of the structural member of the drainage system to an end of a structural member in a different sidewall of the trench.

The method of manufacturing the drainage system may comprise providing an open-faced channel having a first and second lateral side and a first and second end member, wherein the first end member is attached to one end of the first and second lateral sides, the second end member is attached to the opposing end of the first and second lateral sides, and the first and second lateral sides and first and second end members are spaced apart by a predetermined distance to define an interior space therebetween, wherein at least one of said first lateral side, second lateral side, first end member, and second end member define an aperture structured to receive or matingly engage one of the plurality of structural members to thereby tie the drainage system into the structural support for the curable medium. In some embodiments, a different one of said first lateral side, second lateral side, first end member, and second end member may define an additional aperture structured to receive or matingly engage the one of the plurality of structural members.

In accordance with additional embodiments of the present invention, a drainage system having an open-faced channel may be provided. The open-faced channel may be defined by first and second ring members and a collection member. Each of the first and second ring members may comprise a pair of end members and a pair of lateral side members that can be formed integrally together or formed separately and then welded together or secured together using mechanical fasteners. Each of the first and second ring members may define an opening or aperture that is structured to receive the collection member. The first and second ring members may further comprise a plurality of reinforced apertures to which one or more structural members (e.g., rebar) may be attached. In this regard, the collection member may comprise a first set of apertures around a perimeter of the collection member which correspond to the apertures of the first ring member and a second set of apertures around the perimeter of the collection member which correspond to the apertures of the second ring member. Typically, the first ring member is positioned above the second ring member such that the first set of apertures are located above the second set of apertures.

The first ends of a first set of structural members may be inserted through the apertures of the first ring member and the first set of apertures of the collection member, and the first ends of a second set of structural members may be inserted through the apertures of the second ring member and the second set of apertures such that the structural members of the open-faced channel may secure the collection member to first and second ring members. In this way, the collection member may be removably coupled to the first ring member and the second ring member. The second ends of the structural members of the open-faced channel may then be secured to the structural members within the sidewalls of the trench in order to secure the open-faced channel to the trench.

In some embodiments, the first ring member may additionally provide a support surface for installing a trench cover or grate. In some embodiments, the reinforced apertures within the first and second ring members may positioned in a staggered configuration such that the apertures of the first ring member are not vertically aligned with the apertures of the second ring member. In other embodiments, the apertures of the first and second ring members may be positioned in a stacked configuration such that said apertures are vertically aligned with one another.

In accordance with additional embodiments of the present invention, a drainage system comprising an open-faced channel may be provided. The open-faced channel may define an interior, a length, a width, or a depth and may resemble a rectangular prism with solid side surfaces, solid end surfaces, a solid bottom surface, and an open top surface. The interior of the open-faced channel is configured to receive liquids (e.g., rainwater) from a surface (e.g., a driving surface, a roadway, or the like) that are channeled through the open top surface of the open-faced channel. The side and end surfaces of the open-faced channel are typically perpendicularly coupled to the bottom surface so that the open-faced channel forms a bottom portion that resembles an open-topped rectangular prism. The open-faced channel may comprise one or more reinforced apertures distributed laterally around a perimeter of the open-faced channel, wherein the reinforced aperture is a cylindrically-shaped opening oriented perpendicularly to the perimeter of the open-faced channel.

The bottom of the open-faced channel may comprise an aperture such as a conduit channel and associated drainage pipe extended from the conduit channel. The conduit channel and drainage pipe may be connected to any section of the bottom wall of the open-faced channel. The remaining portions of the bottom wall of the open-faced channel may be slanted at an angle in the direction of the conduit channel, such that fluid entering the open-faced channel is directed to the drainage pipe for drainage from the open-faced channel.

One or more coupling extensions (which may be referred to herein as "coupling members") may be positioned proximate to a top portion of the sidewalls and extend from the outer side walls of the open-faced channel for coupling the open-faced channel to a structure, such as a trench. The coupling member may comprise a diagonally oriented hollow portion configured to accept a removable retention pin, wherein the removable retention pin is configured to secure the open-faced channel within a curable medium or moldable composition. One or more pipe-to-pipe sleeves may also extend from the outer surface of the open-faced channel. In some embodiments, a hole is located through a sidewall in the open-faced channel and is in fluid connection with the pipe sleeve. In some embodiments, removable retaining pins may be located on the interior of the open-faced channel extending from the interior corners of the open-faced channel.

BRIEF DESCRIPTION OF THE SEVERAL VIEWS OF THE DRAWINGS

Figure 1:
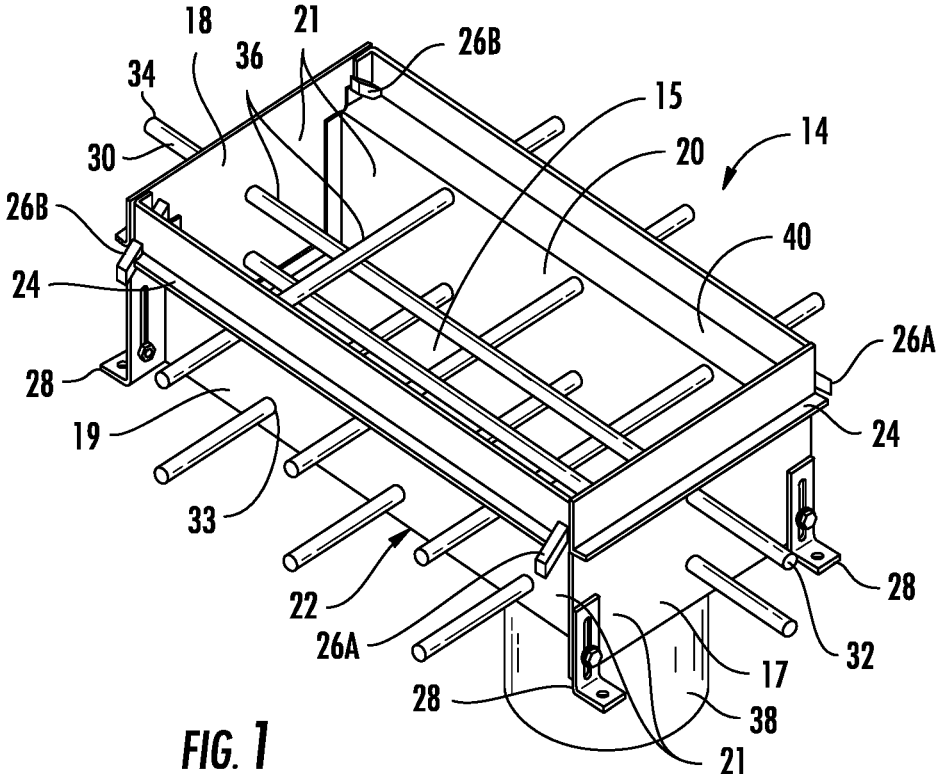
Figure 2A:
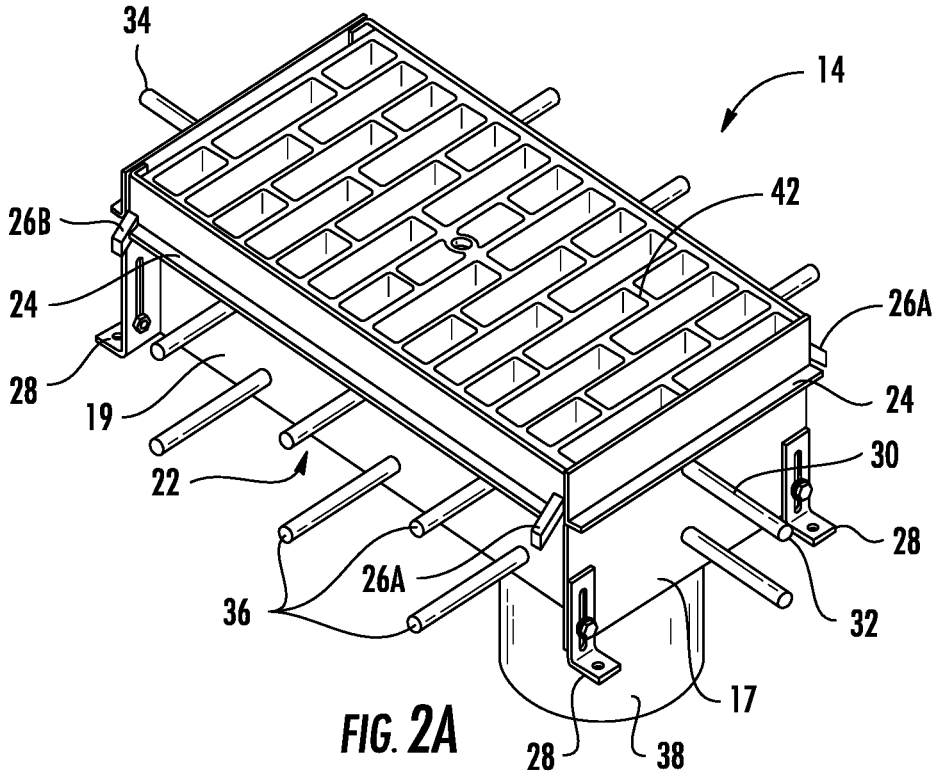
Figure 2B:
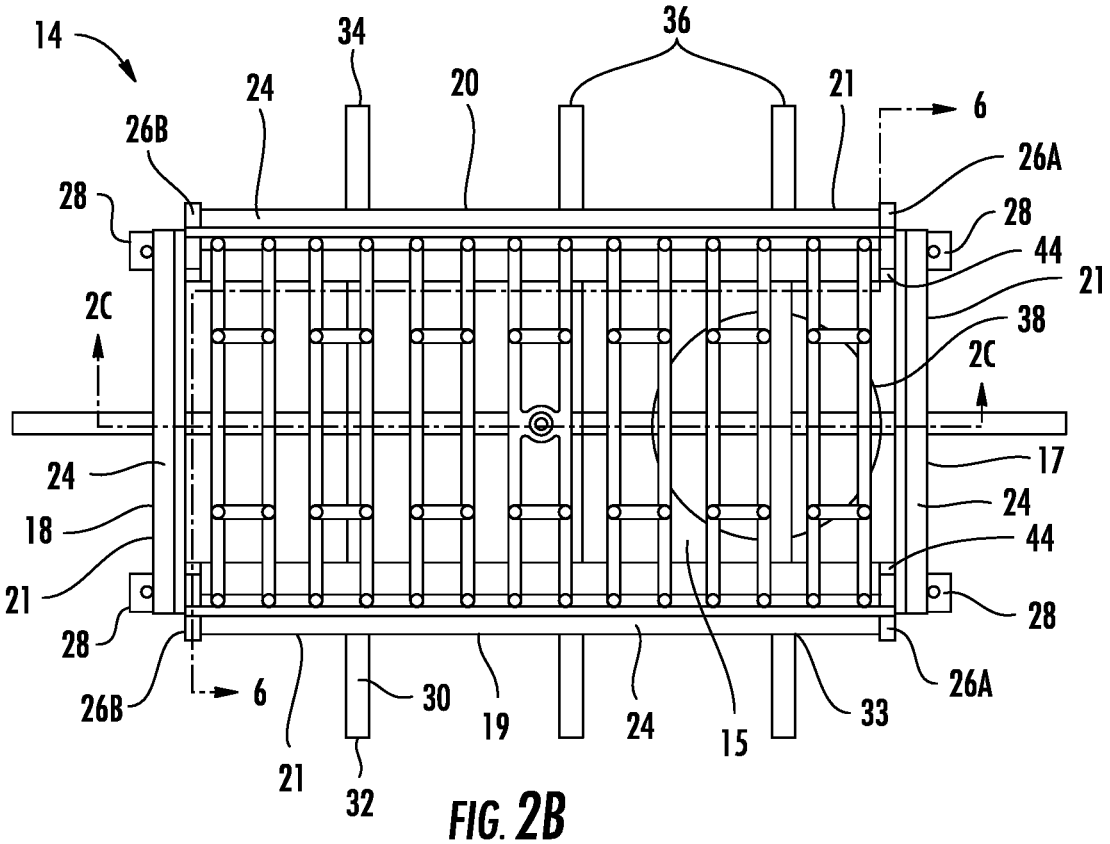
Figure 2C:
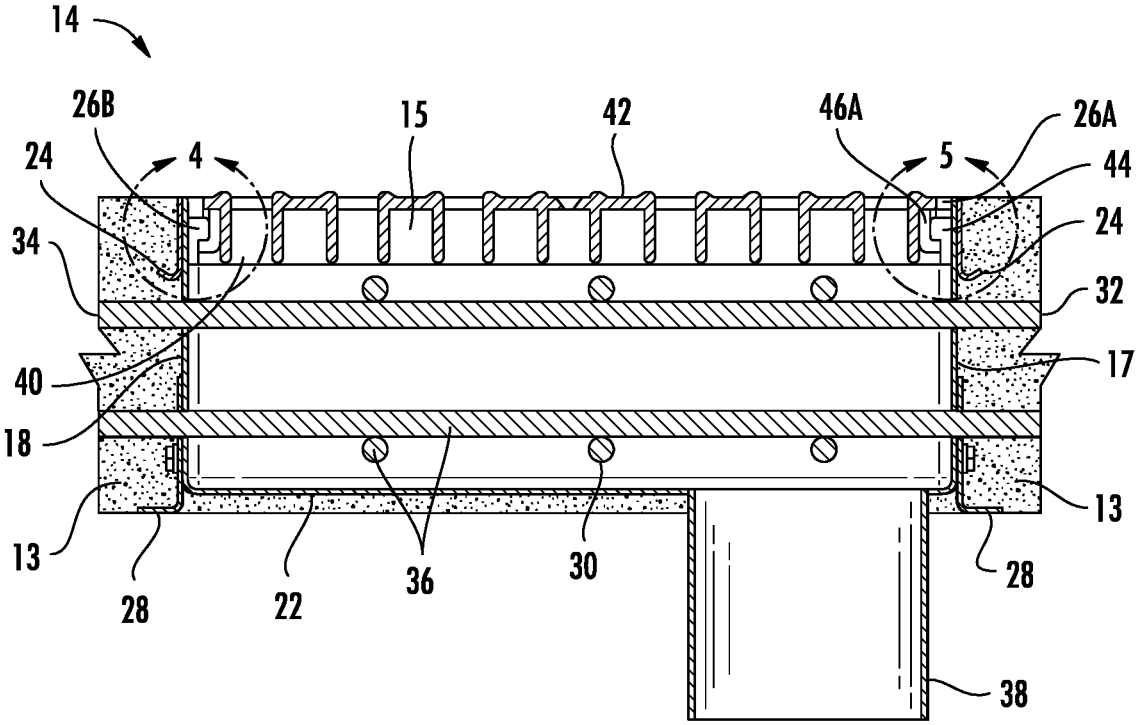
Figure 3:
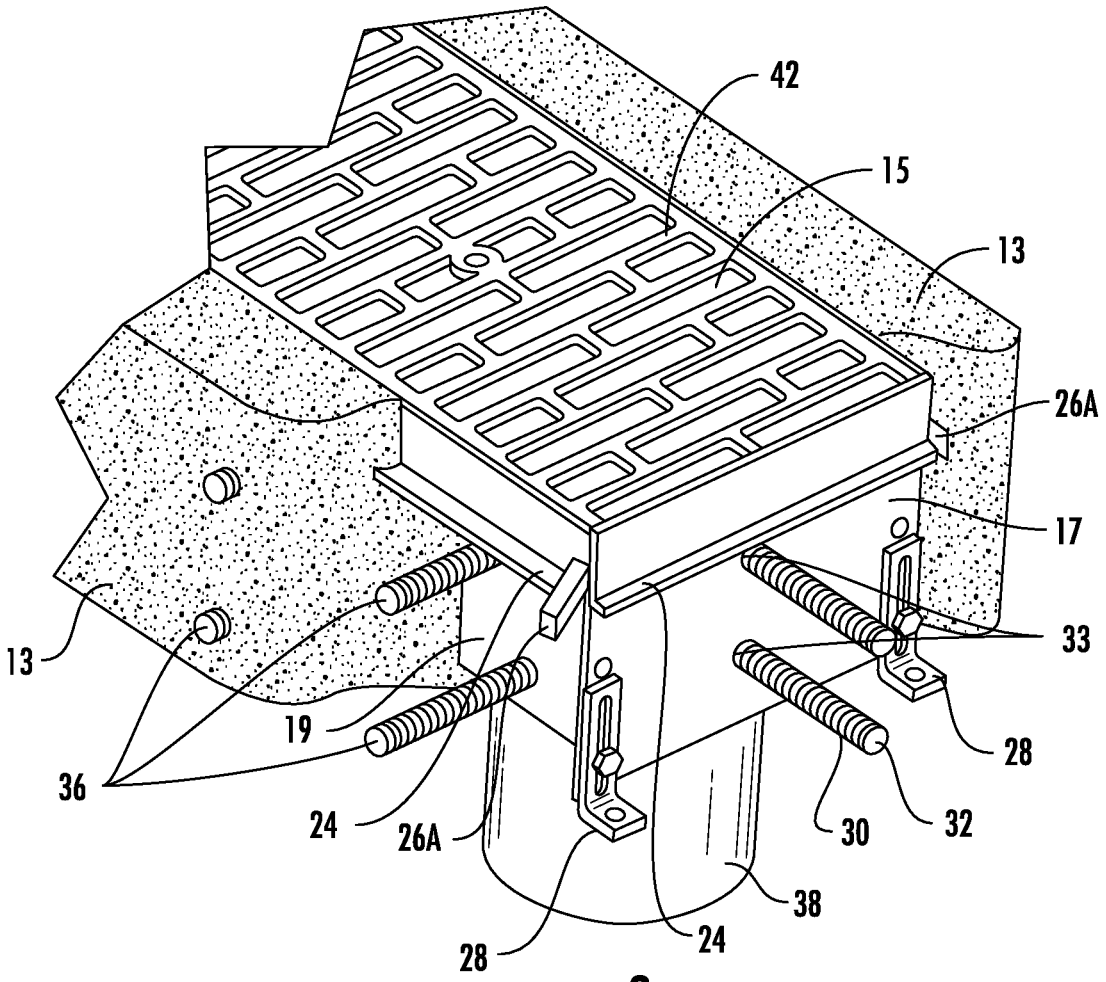
Figure 4:
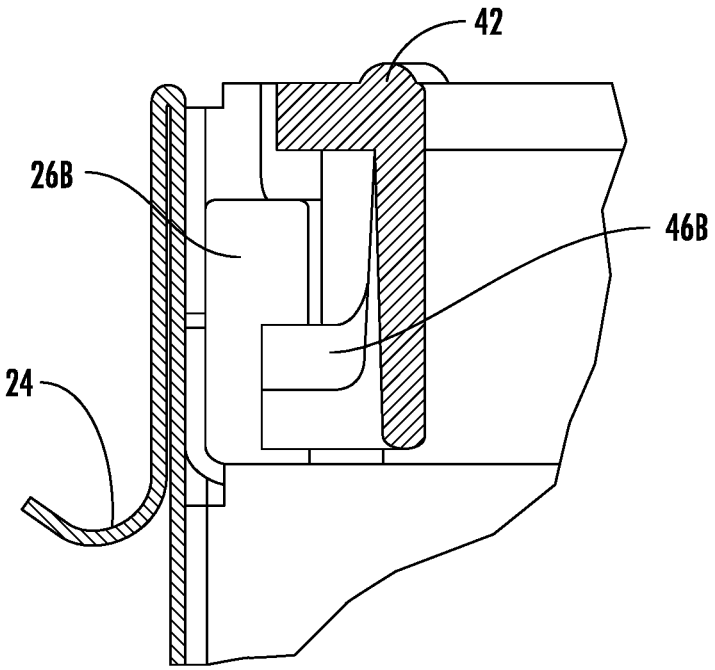
Figure 5:
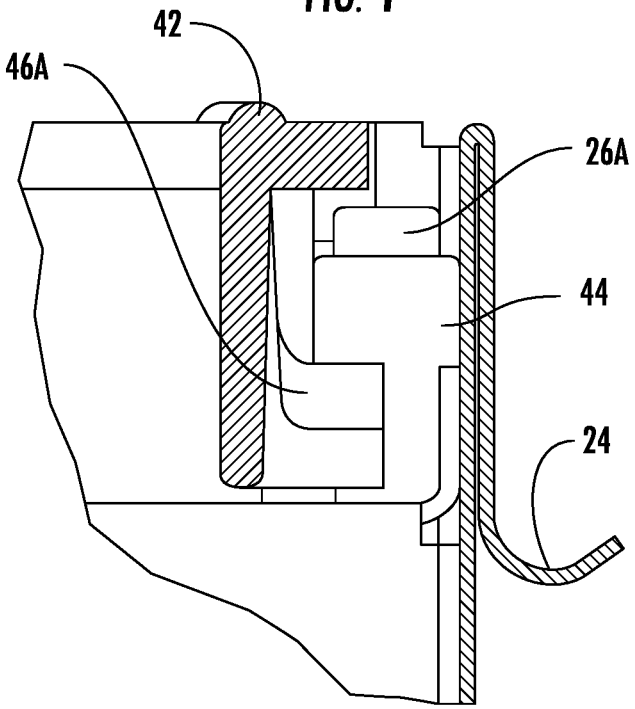
Figure 6:
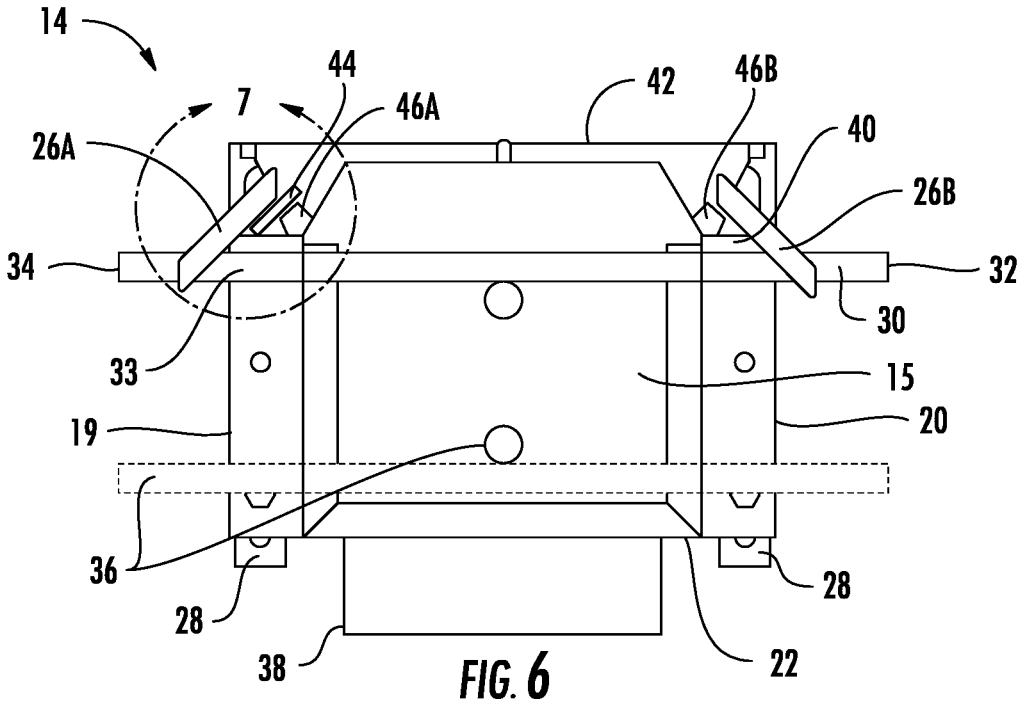
Figure 7:
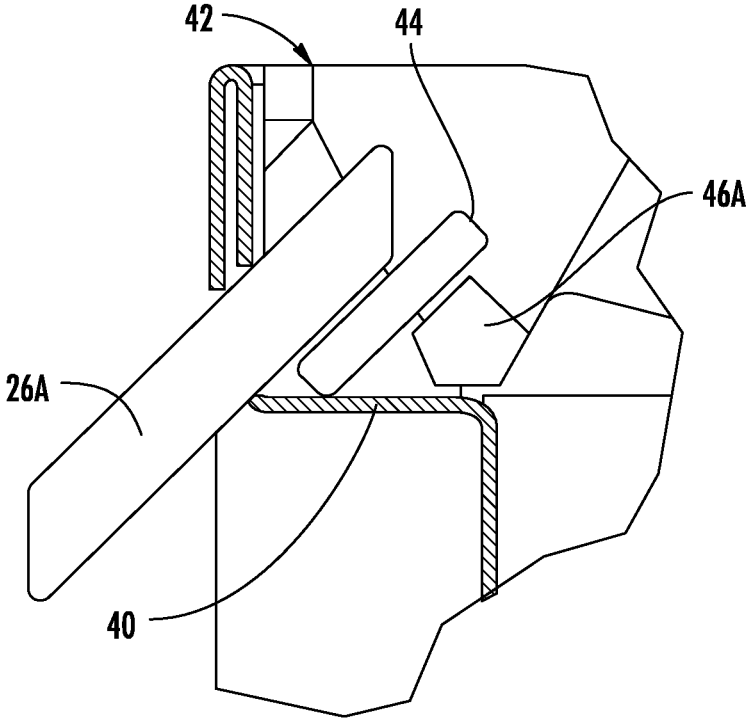
Figure 8A:
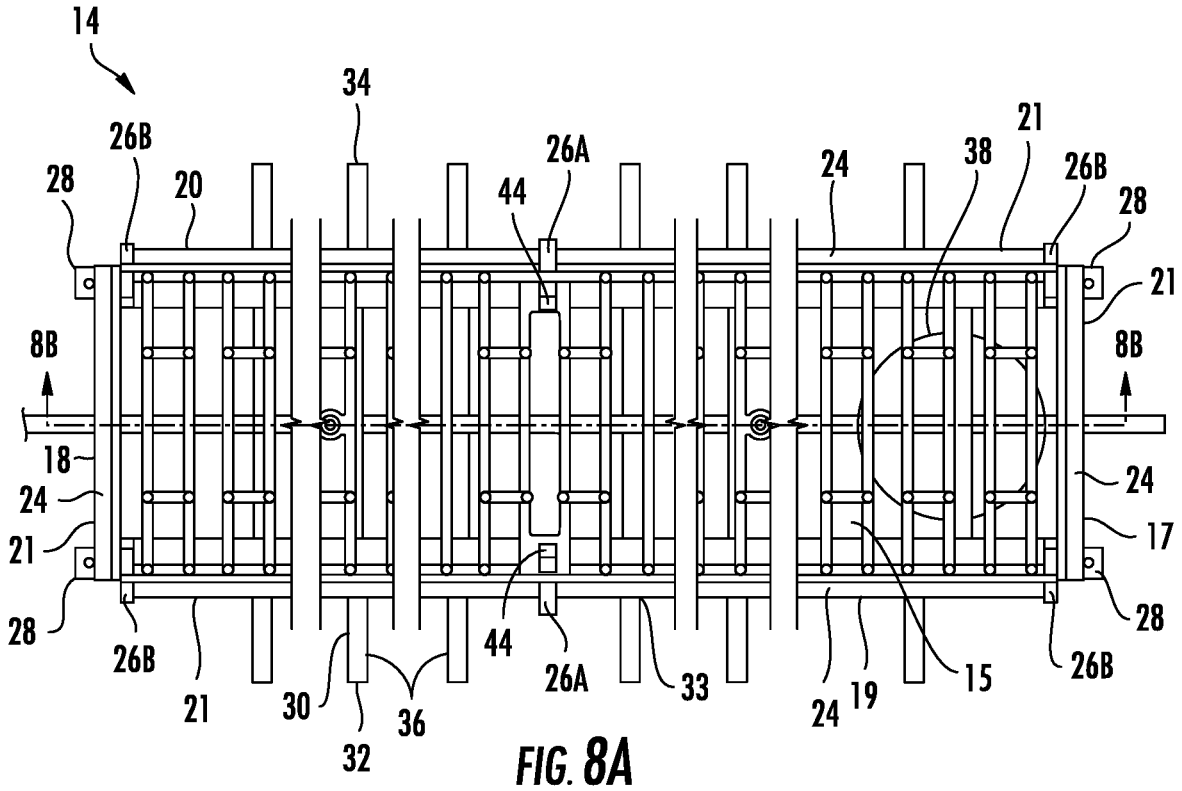
Figure 8B:
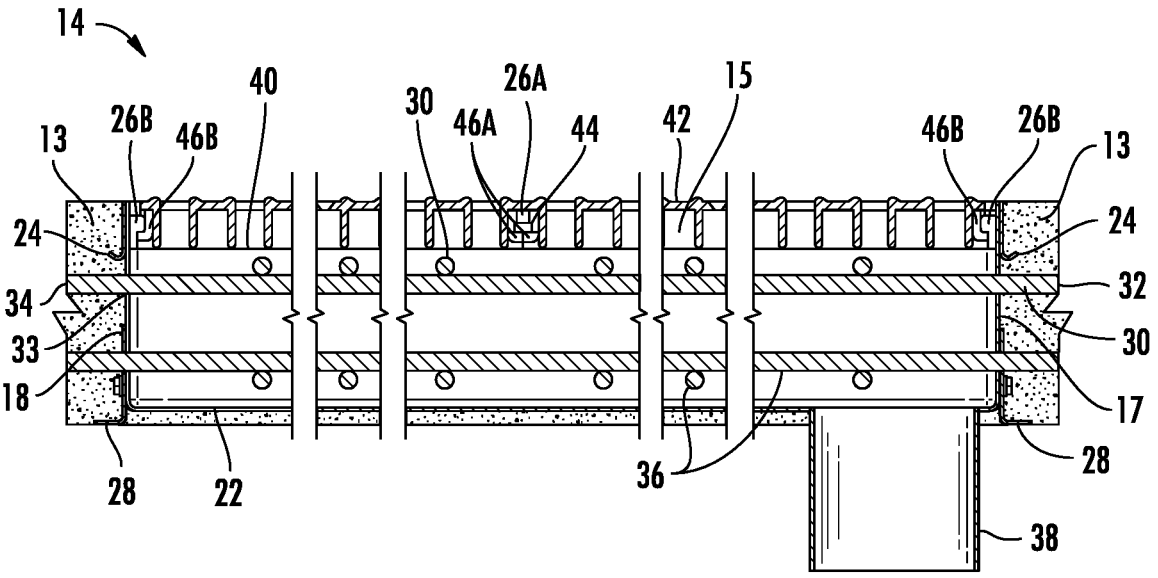
Figure 9A:
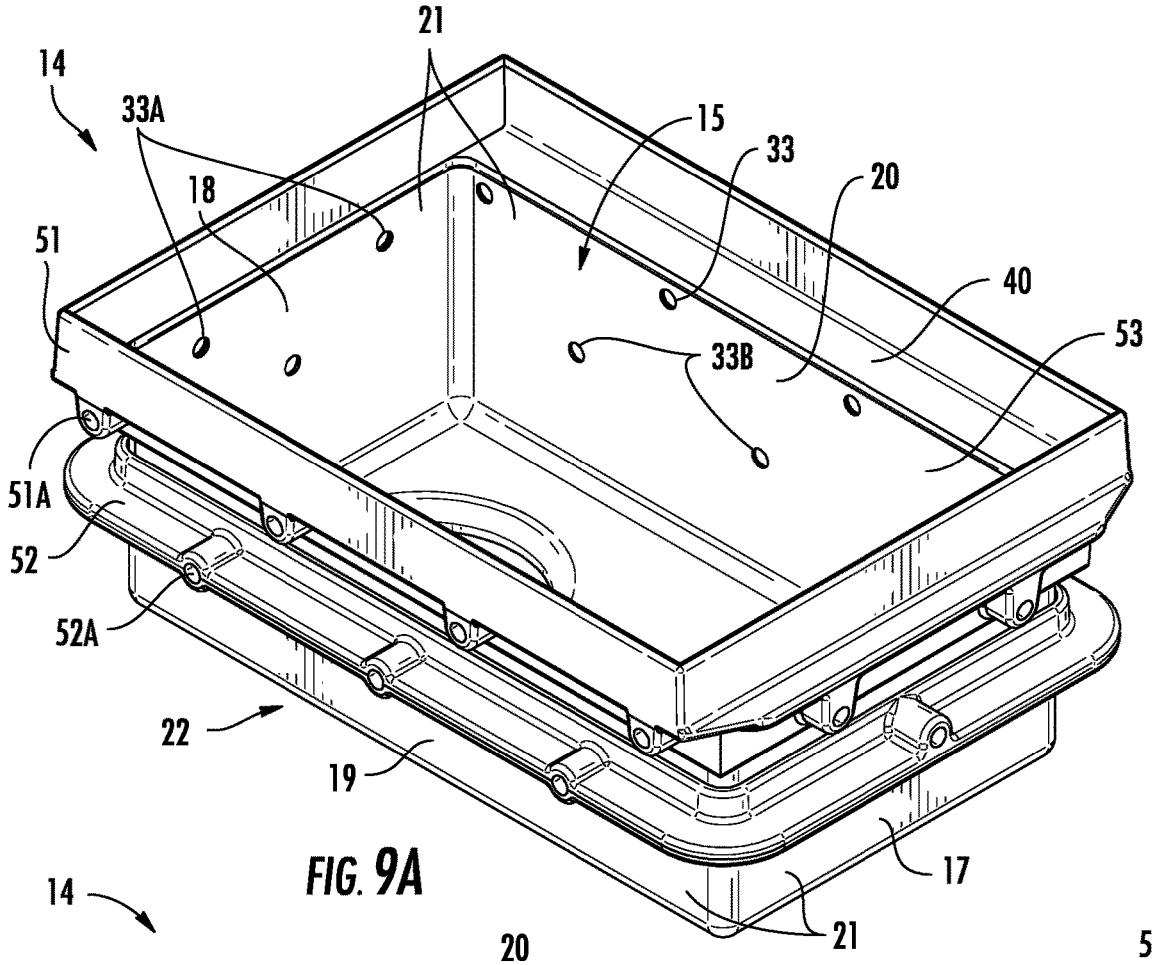
Figure 9B:
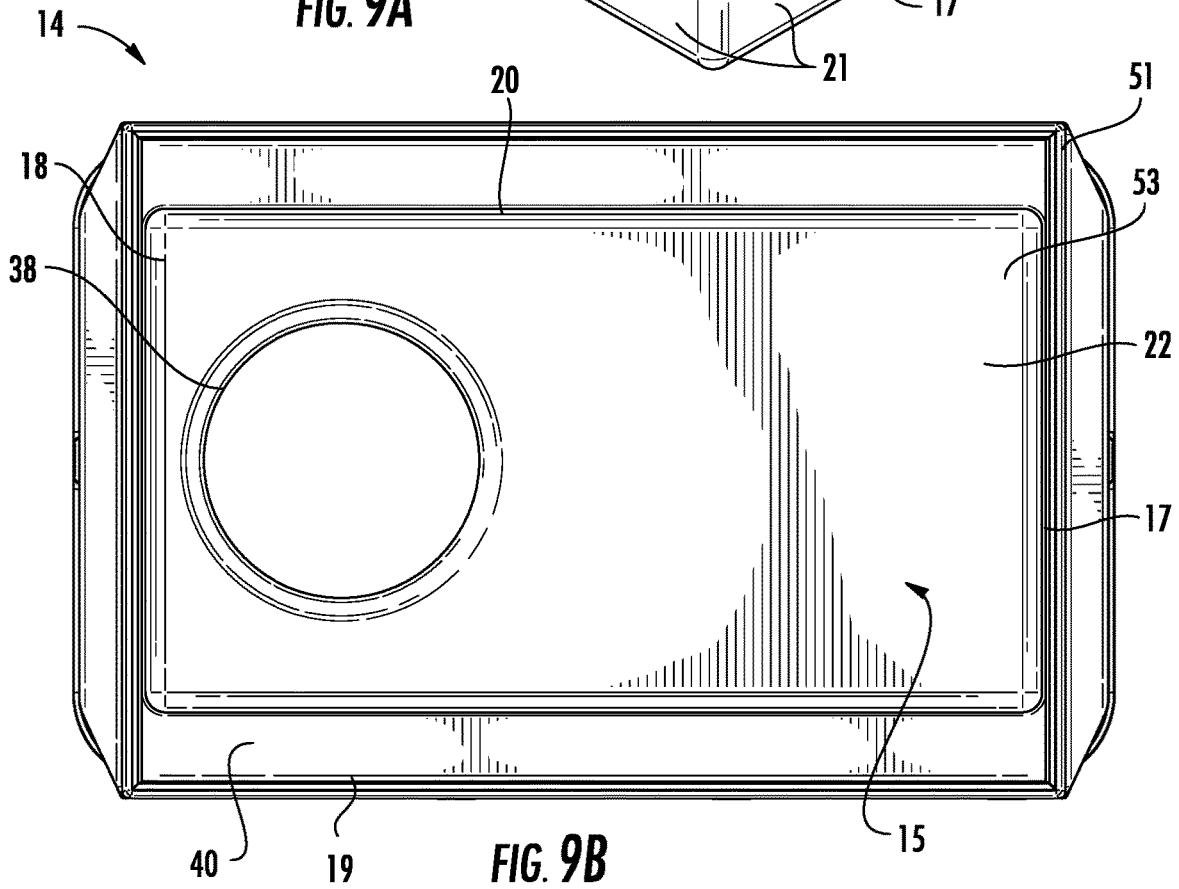
Figure 9C:
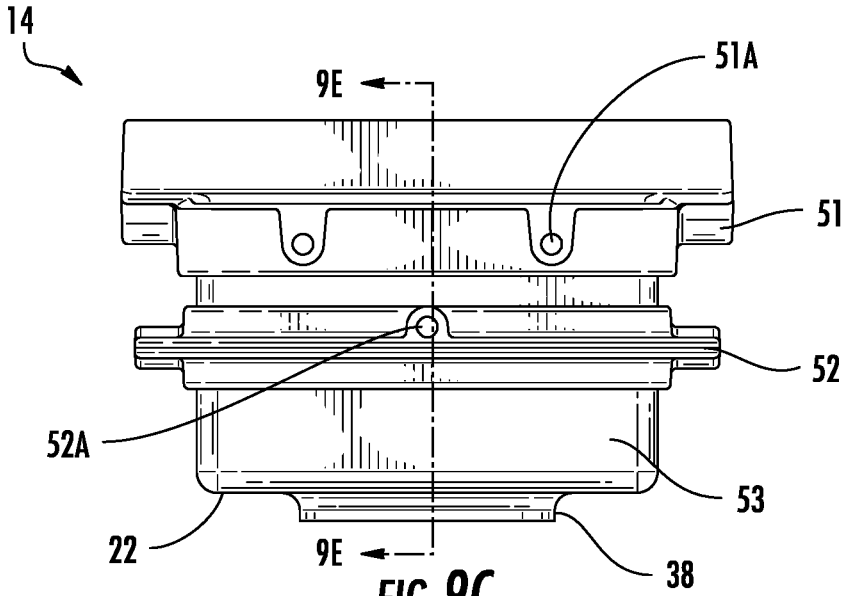
Figure 9D:
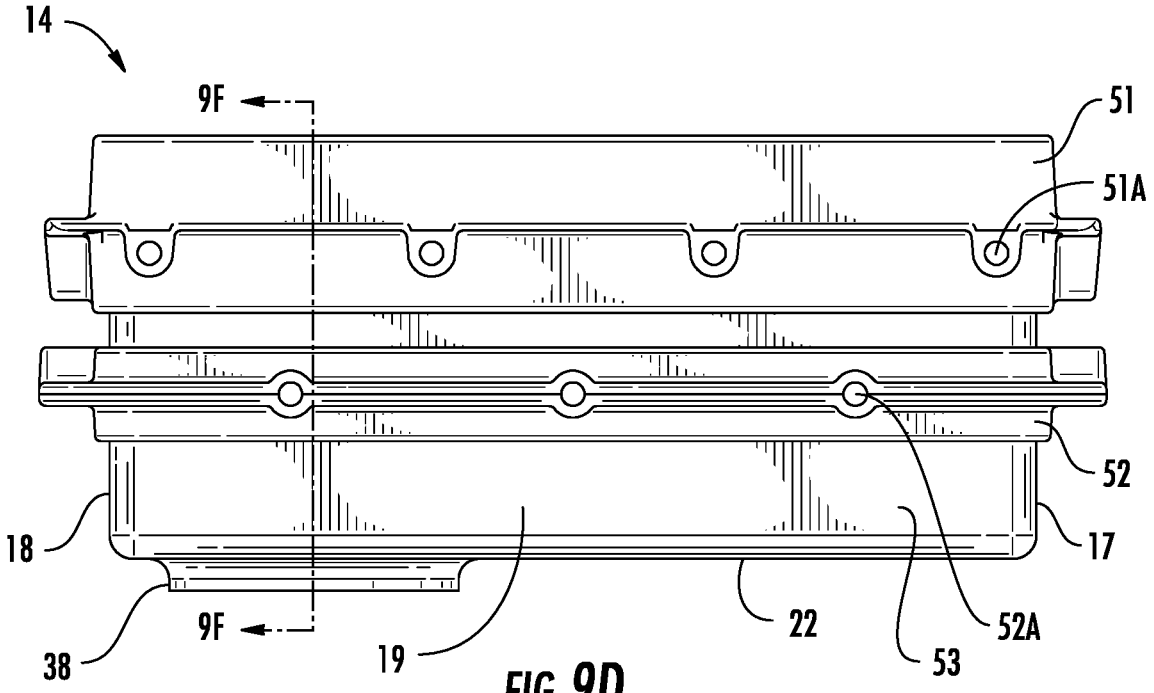
Figure 9E:
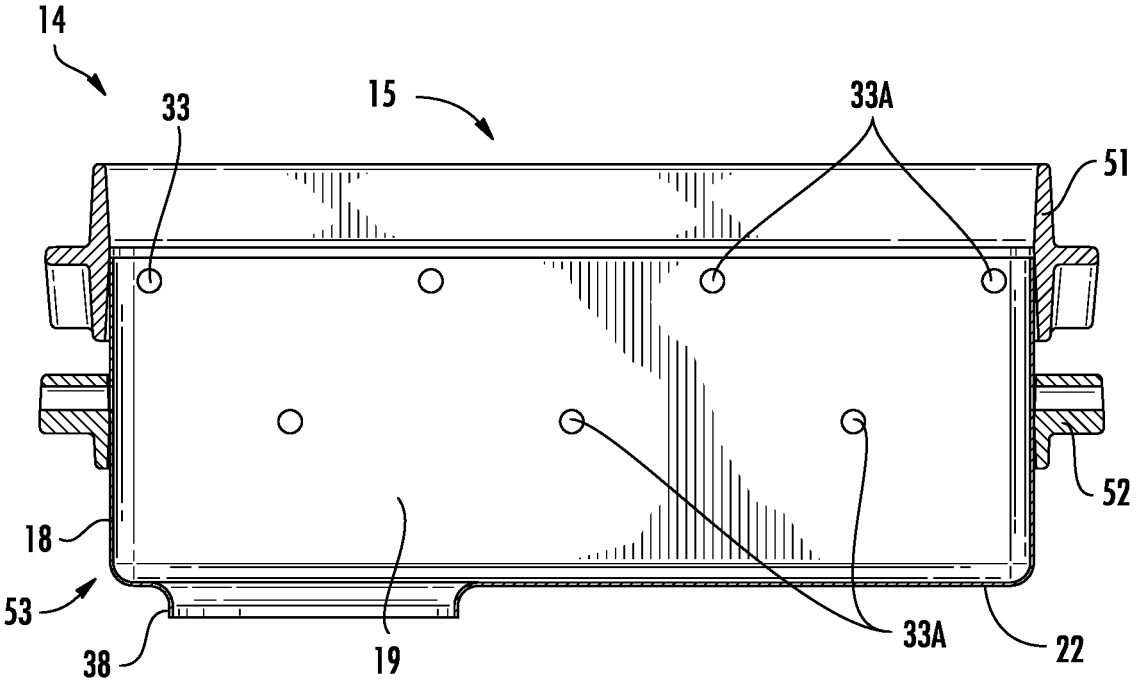
Figure 9F:
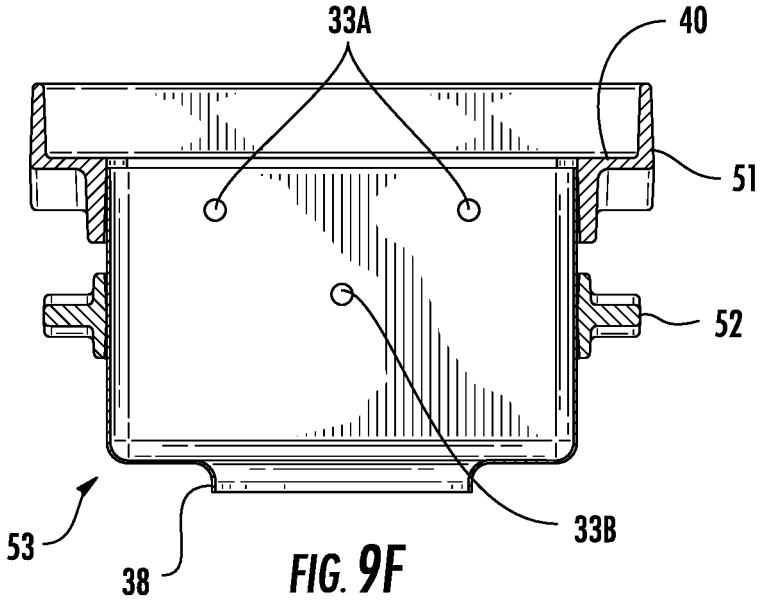
Figure 9G:
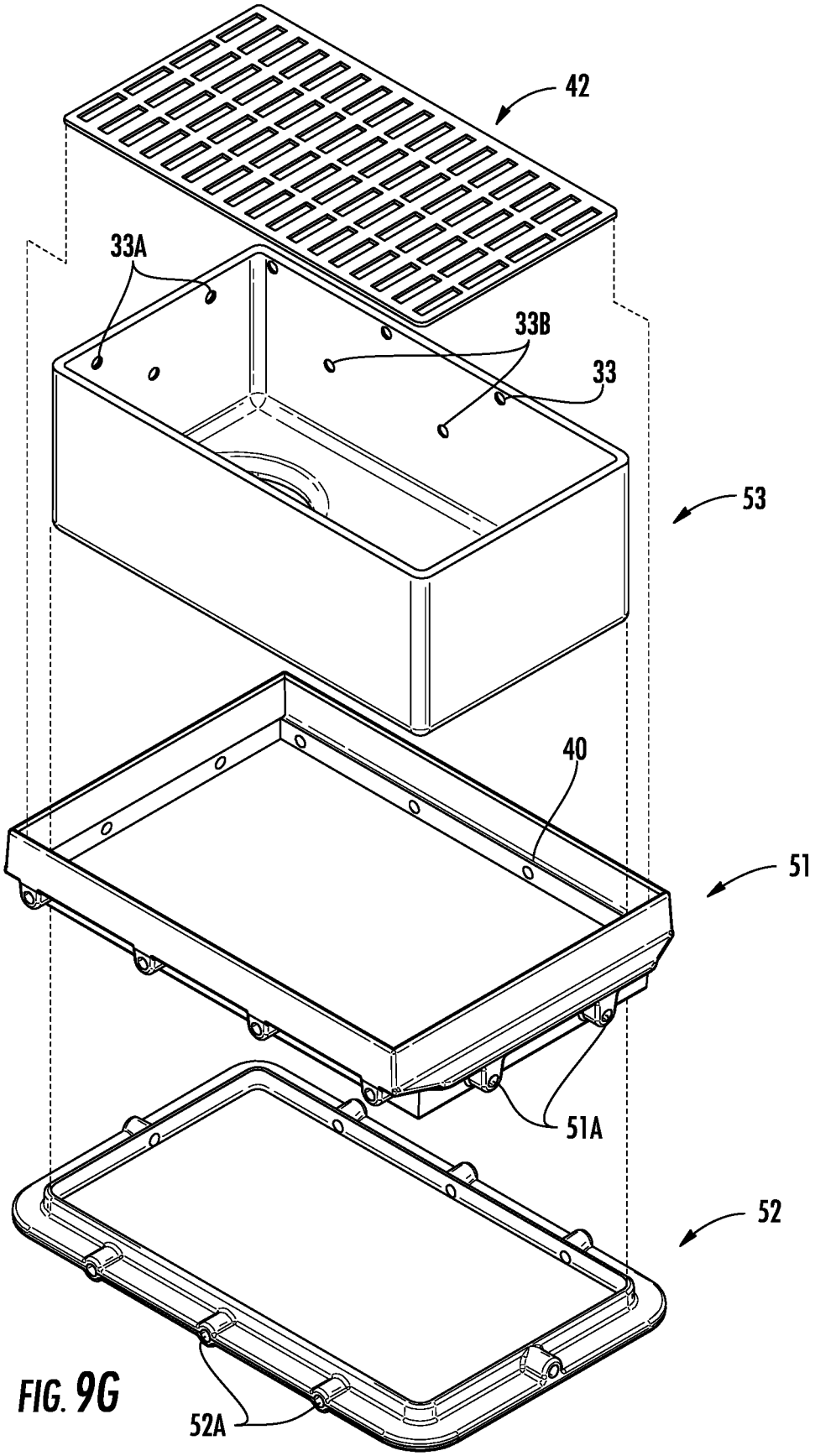
Figure 10A:
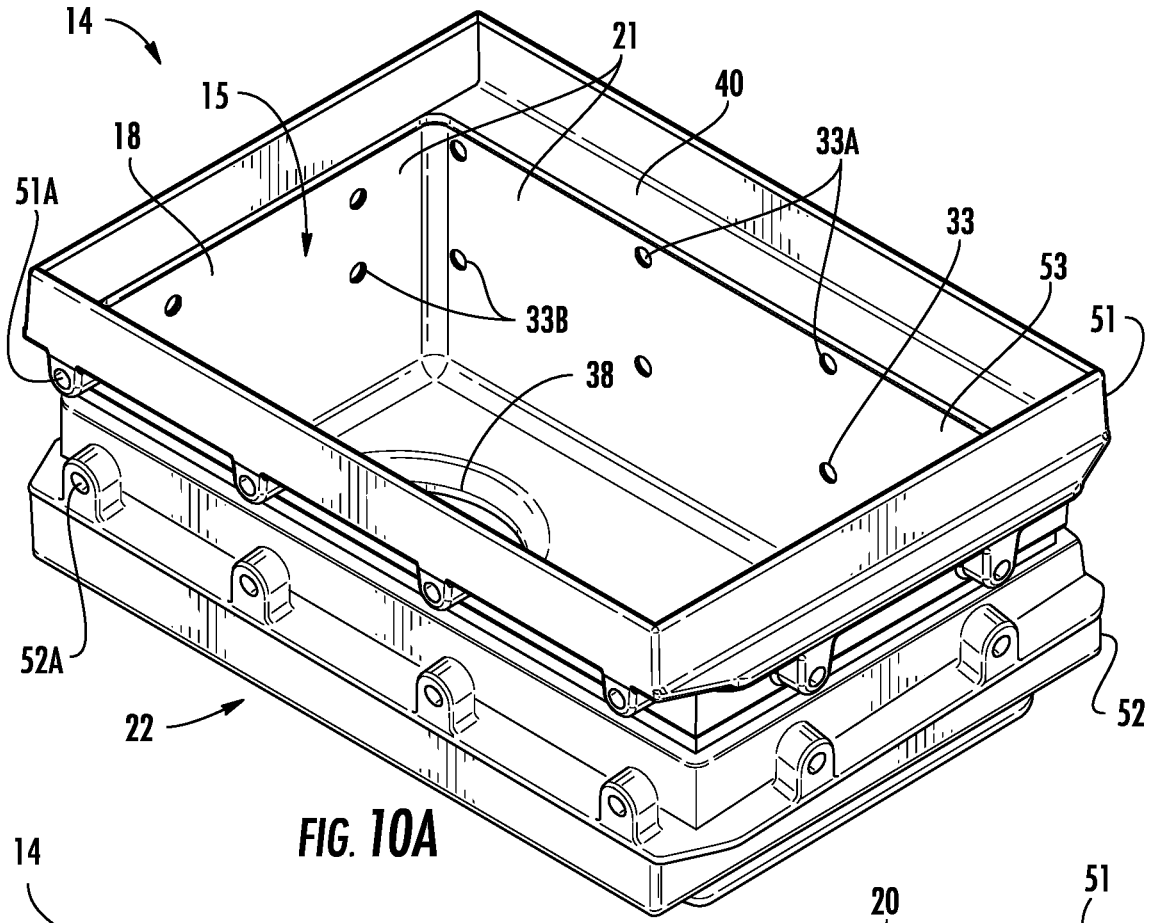
Figure 10B:
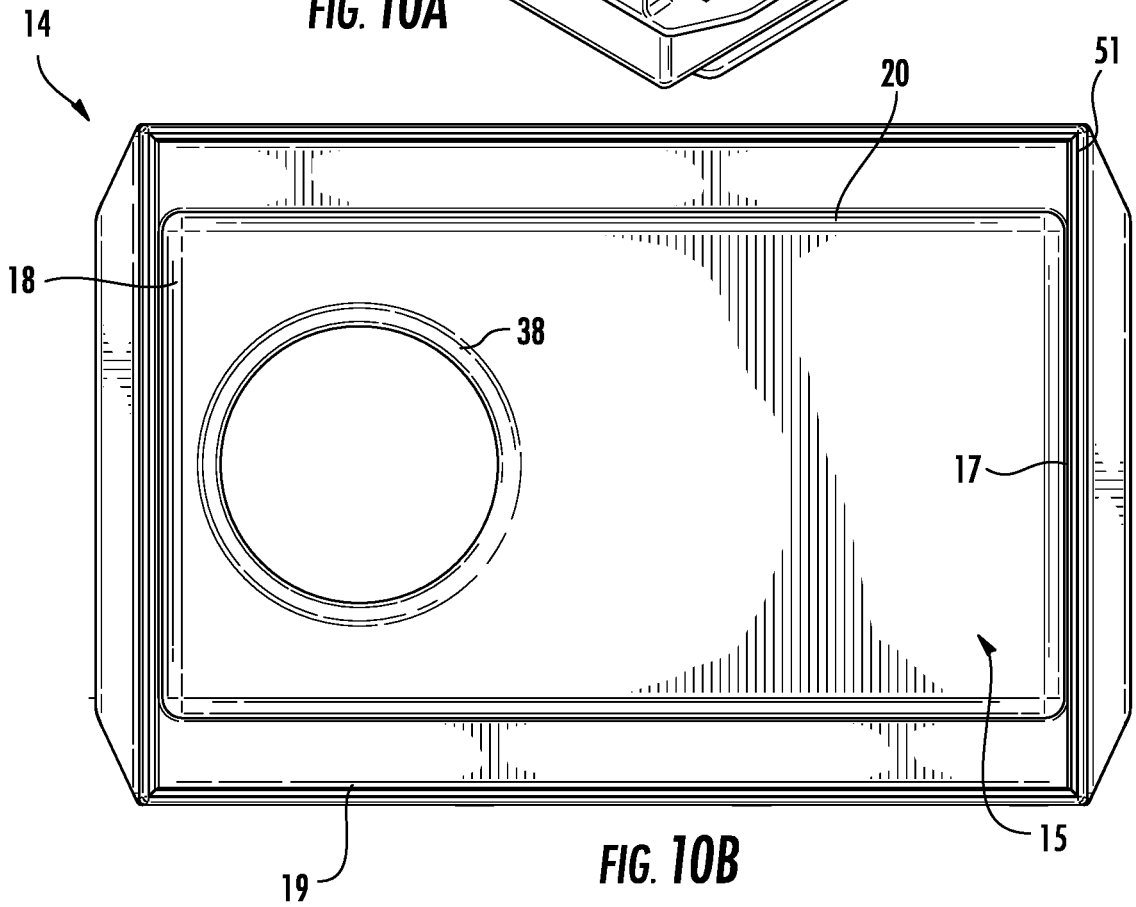
Figure 10C:
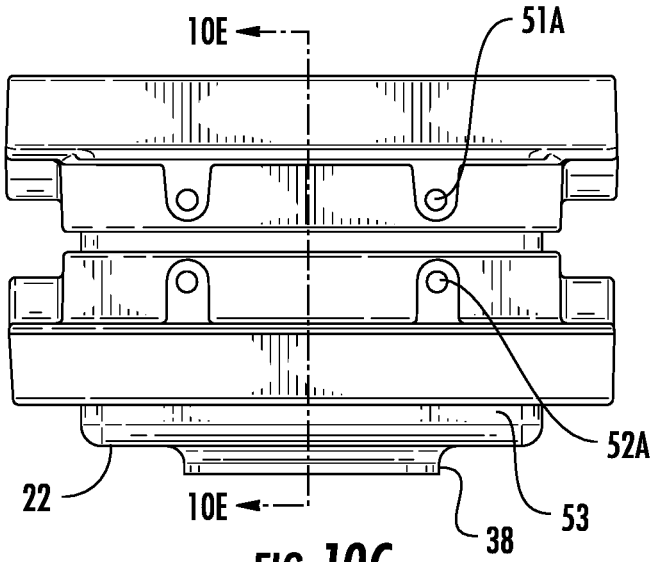
Figure 10D:
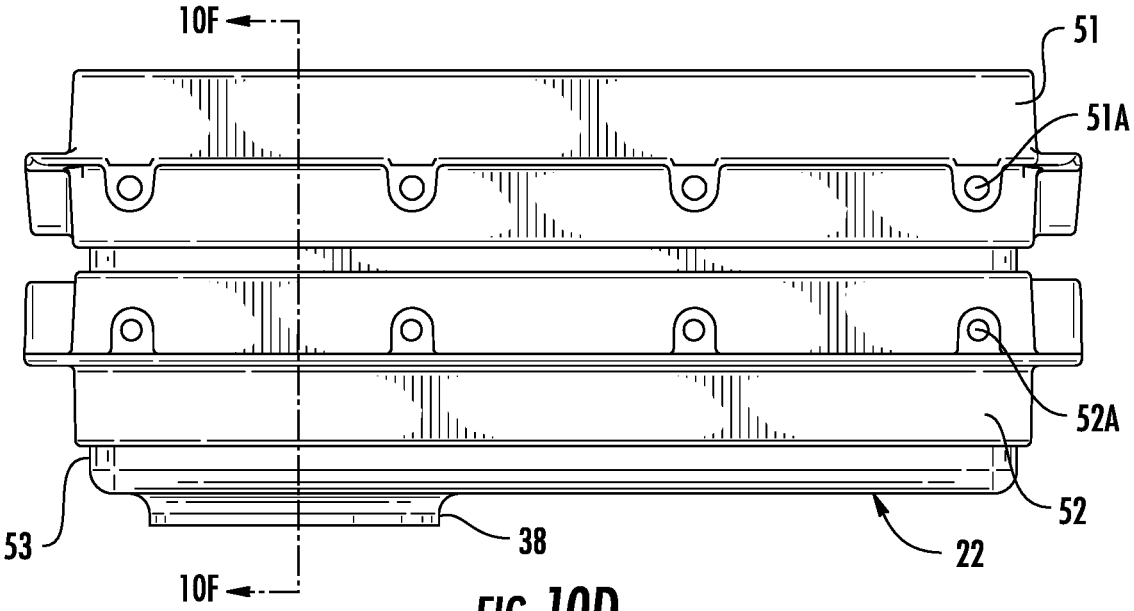
Figure 10E:
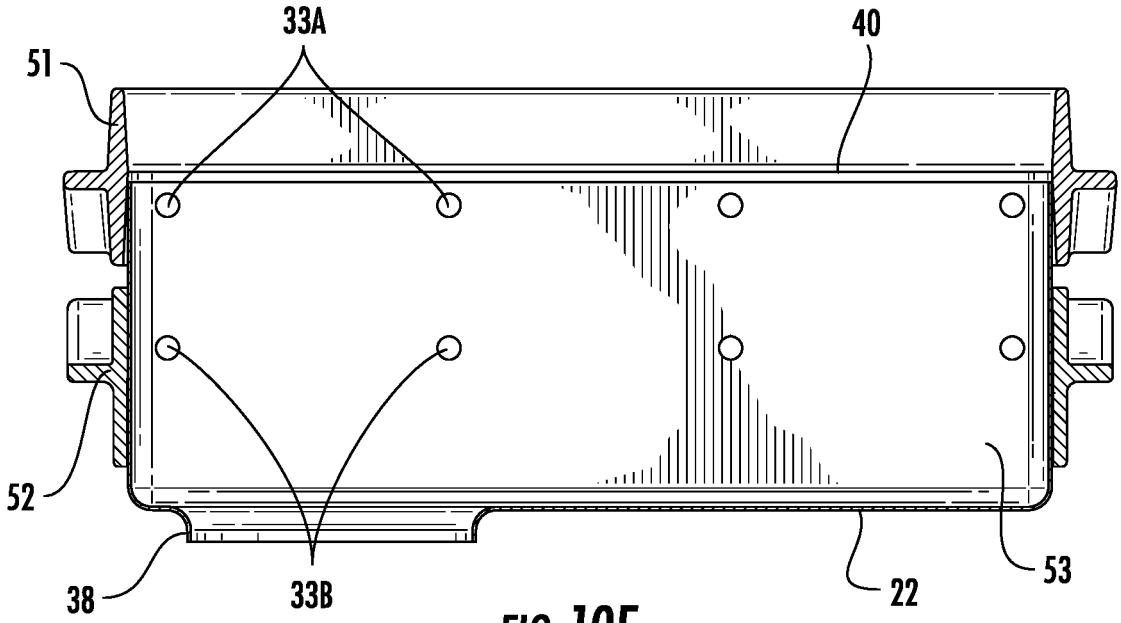
Figure 10F:
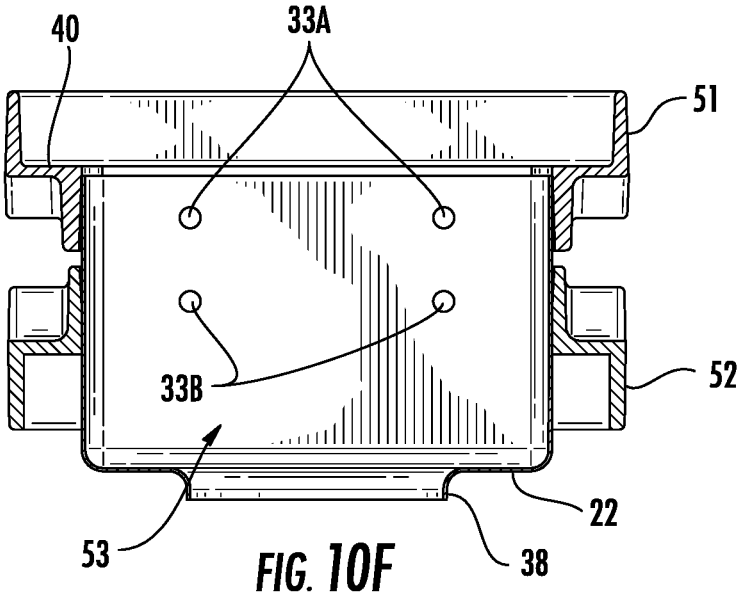
Figure 11A:
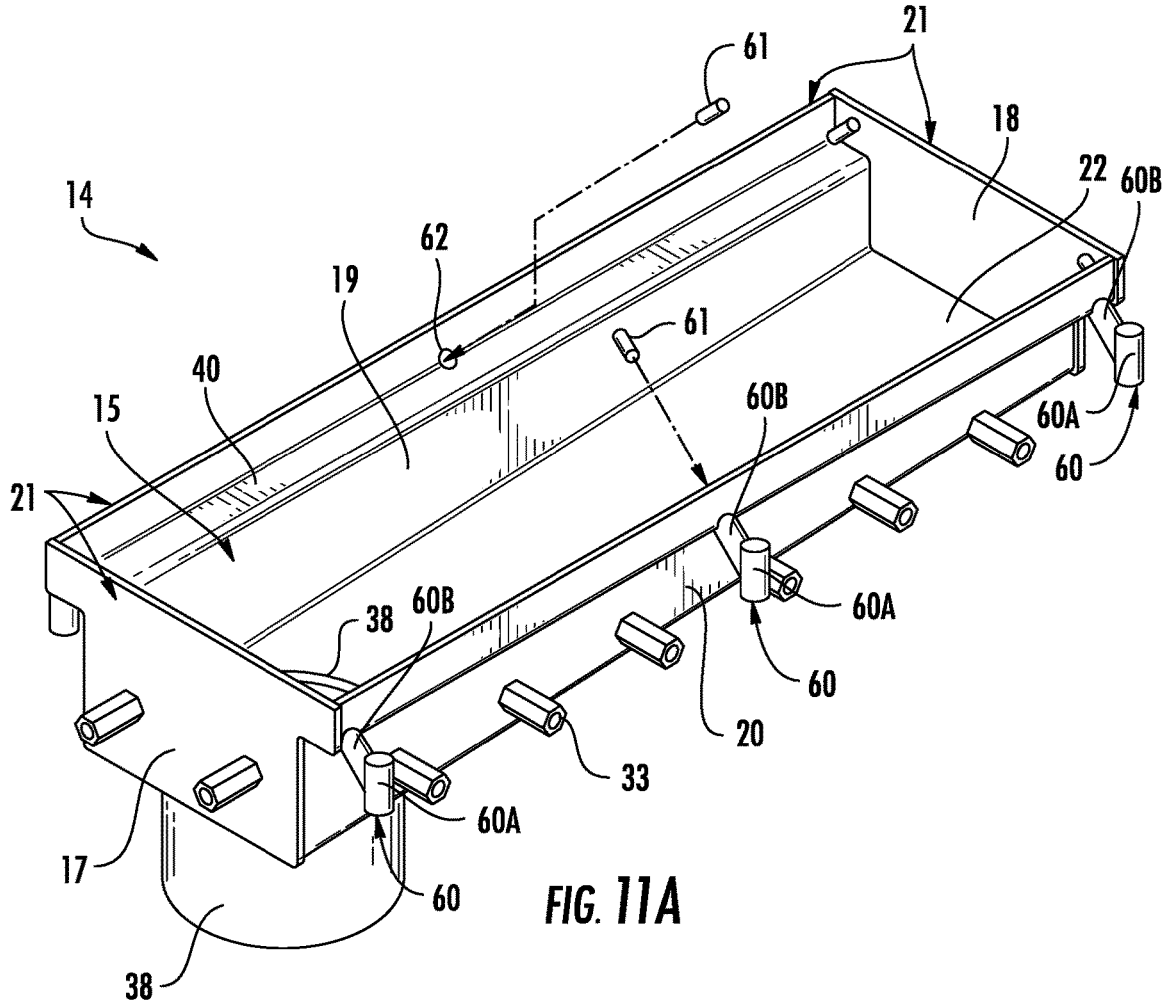
Figure 11B:
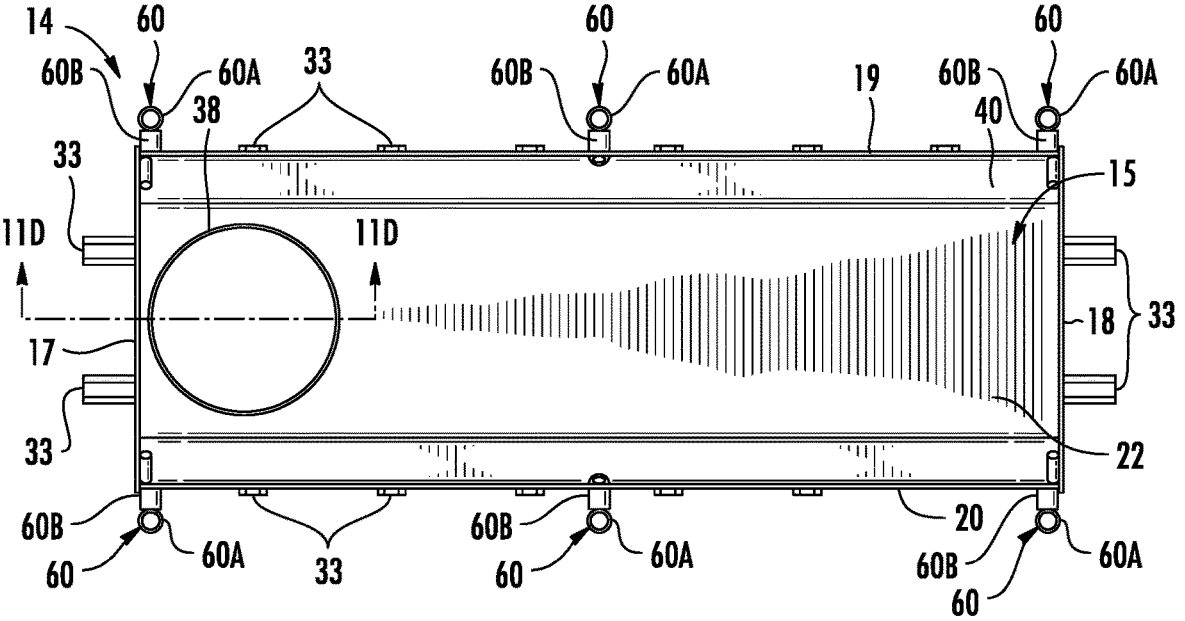
Figure 11C:
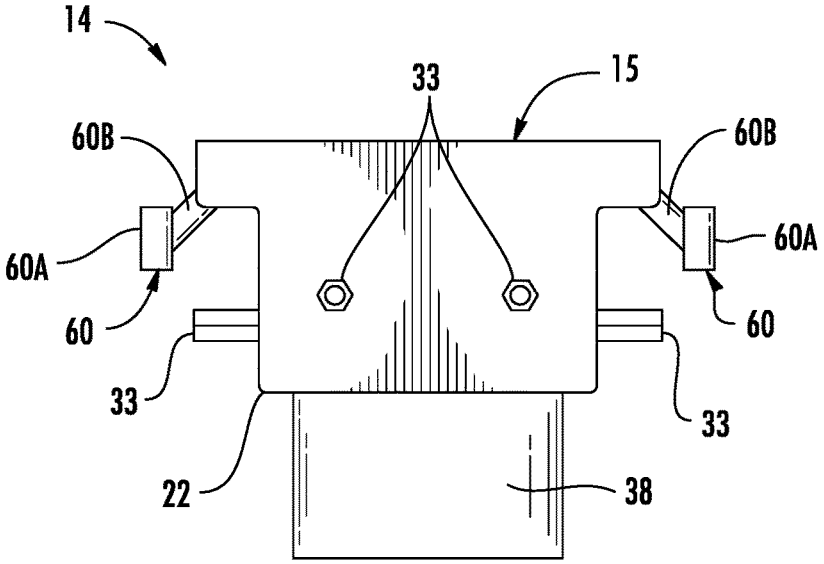
Figure 11D:
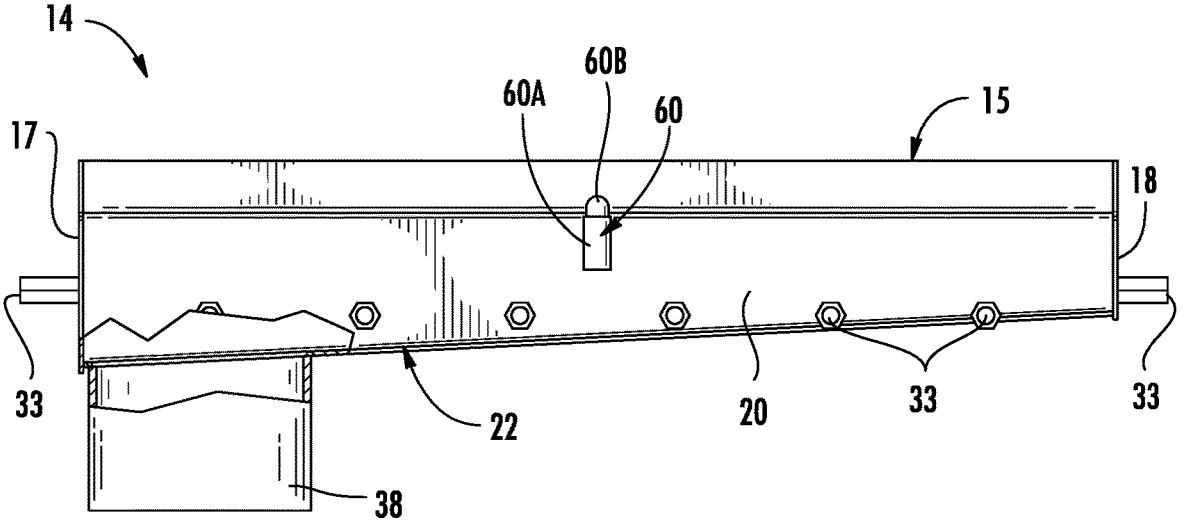

Having thus described embodiments of the invention in general terms, reference will now be made to the accompanying drawings, which are not necessarily drawn to scale, and wherein:

FIG. 1 is a top, left-side perspective view of a drainage system according to one embodiment of the present invention before being placed into a trench and secured with a moldable composition;

FIG. 2A is a top, left-side perspective view of a drainage system according to a second embodiment of the present invention, comprising a trench cover, before being placed into a trench and secured with a curable medium;

FIG. 2B is a plan view of the drainage system shown in FIG. 2A;

FIG. 2C is a cross-sectional view of the section 2C designated by the upwards arrows of the drainage system shown in FIG. 2B after being placed into a trench and secured with a curable medium;

FIG. 3 is a top, left-side perspective view of the drainage system shown in FIG. 2 after being placed into a trench and secured with a curable medium;

FIG. 4 is an enlarged cross-sectional view of the section 4 designated by the inwards arrows of the broken oval of the drainage system shown in FIG. 2C;

FIG. 5 is an enlarged cross-sectional view of the section 5 designated by the inwards arrows of the broken oval of the drainage system shown in FIG. 2C;

FIG. 6 is a cross-sectional view of the section 6 designated by the rightwards arrows of the drainage system shown in FIG. 4;

FIG. 7 is an enlarged cross-sectional view of the section 7 designated by the inwards arrows of the broken circle of the drainage system in FIG. 6;

FIG. 8A is a plan view of a drainage system in accordance with another embodiment of the present invention before being placed into a trench and secured with a curable medium;

FIG. 8B is a cross-sectional view of the section 8B designated by the upwards arrows of the drainage system shown in FIG. 8A after being placed into a trench and secured with a curable medium;

FIG. 9A is top, left-side perspective view of a drainage system according to another embodiment of the present invention before being placed into a trench and secured with a curable medium;

FIG. 9B is a plan view of the drainage system shown in FIG. 9A;

FIG. 9C is a cross-sectional front view of the drainage system shown in FIG. 9A;

FIG. 9D is a cross-sectional side view of the drainage system shown in FIG. 9A;

FIG. 9E is a cross-sectional cutaway view of the section 9E designated by the leftward arrows of the drainage system shown in FIG. 9C;

FIG. 9F is a cross-sectional cutaway view of the section 9F designated by the leftward arrows of the drainage system shown in FIG. 9D;

FIG. 9G is an exploded view of the drainage system as shown in FIG. 9A;

FIG. 10A is a top, left-side perspective view of a drainage system according to another embodiment of the present invention before being placed into a trench and secured with a curable medium;

FIG. 10B is a plan view of the drainage system shown in FIG. 10A;

FIG. 10C is a cross-sectional view of the section 10C designated by the leftward arrows of the drainage system shown in FIG. 10D;

FIG. 10D is a cross-sectional view of the section 10D designated by the leftward arrows of the drainage system shown in FIG. 10C;

FIG. 10E is a cross-sectional cutaway view of the section 10E designated by the leftward arrows of the drainage system shown in FIG. 10C;

FIG. 10F is a cross-sectional cutaway view of the section 10F designated by the leftward arrows of the drainage system shown in FIG. 10D;

FIG. 11A is a top, right-side perspective view of a drainage system according to another embodiment of the present invention before being placed into a trench and secured with a curable medium;

FIG. 11B is a plan view of the drainage system shown in FIG. 11A;

FIG. 11C is a cross-sectional front view of the drainage system shown in FIG. 11A; and FIG. 11D is a cross-sectional view of the section 11D designated by the upward arrows of the drainage system shown in FIG. 11B.

DETAILED DESCRIPTION OF EMBODIMENTS OF THE INVENTION

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Referring to the drawings and, in particular, FIGS. 1-8B, a drainage system 14 having an open-faced channel 15 is illustrated prior to being placed in a preformed trench and secured with a curable medium 13 (which may also be referred to herein as "moldable composition"), as can be seen in FIG. 3. The curable medium 13 may be a pourable mixture such as cement, which may include various cementitious materials. The open-faced channel 15 has a first and second end member 17, 18 and a first and second lateral side 19, 20, as shown in FIG. 1. Individually, each end member 17, 18 and lateral side 19, 20 is a sidewall of the open-faced channel 15, and collectively, the first and second end members 17, 18 and first and second lateral sides 19, 20 make up the sidewalls 21, where the lateral sides 19, 20 and end members 17, 18 are connected at the edges in a substantially perpendicular manner to form a rectangular shape.

In particular, the first end member is 17 attached to one end of the first and second lateral sides 19, 20, and the second end member 18 is attached to the opposing second end of the first and second lateral sides 19, 20. In this way, the lateral sides 19, 20 are substantially parallel to each other and the end members 17, 18 are substantially parallel to each other, such that the first and second lateral sides 19, 20 and the first and second end members 17, 18 are spaced apart by predetermined distances to define an interior space therebetween. In an exemplary embodiment, the distance between the first and second lateral sides 19, 20 may be 8-14 inches, and the distance between the first and second end members 17, 18 may be 20-45 inches. It should be understood that the foregoing dimensions are provided for illustrative purposes only, and that it is fully within the scope of the present disclosure for other dimensions to be used as required by the applications for which the drainage system is to be used. As shown in FIG. 2C and 8B, the drainage system 14 can also include a bottom wall 22, whereby the sidewalls 21 extend upwardly from opposite sides of the bottom wall 22.

As best shown in FIGS. 1, 2A-2C, and 3-5, the sidewalls 21 preferably include one or more anchor flanges 24 extending along the length of the sidewalls 21 to retain the position of the drainage system 14 when the curable medium 13 is poured around the open-faced channel 15. Typically, the curable medium 13 is poured to a level that rises above the anchor flanges 24 such that the anchor flanges 24 become embedded within the curable medium 13 once the curable medium 13 has hardened. The anchor flanges 24 are preferably continuous and integrally formed in the sidewalls 21 to facilitate the retention of the position of the open-faced channel 15 within the curable medium 13.

As best shown in FIGS. 1, 2A, and 2C, the open-faced channel 15 may comprise one or more installation legs 28 that may be secured to the curable medium 13 and/or the preformed trench. In a preferred embodiment, the installation legs 28 may be L-shaped such that the installation leg 28 is divided into a short portion and a long portion, where the short portion is perpendicularly attached to the long portion. The short portion of the installation leg 28 may comprise a hole through which fastening elements may be inserted to secure the installation leg 28 to the trench and/or the curable medium 13. Said fastening elements may include screws, nuts, bolts, clips, pins, or the like. The long portion of the installation leg 28 may comprise a vertical adjustment slot through which an adjustable fastening element may be placed to adjustably attach the installation leg 28 to a sidewall 21 of the open-faced channel 15. The adjustable nature of the adjustable fastening element and vertical adjustment slot facilitate positioning the open-faced channel 15 at a desired height within the preformed trench and retaining that desired height when the curable medium 13 is poured around the open-faced channel 15.

The open-faced channel 15 can be formed from any suitable material, such as a cementitious and/or thermosetting or thermoplastic polymeric material. For example, the open-faced channel 15 can be formed from a polymer/concrete aggregate material. More particularly, the open-faced channel 15 of one advantageous embodiment is formed from a thermosetting polymeric resin, such as acetone, and an aggregate material. The aggregate material is preferably a chemically inert material, such as silica or glacial till. In one embodiment, the open-faced channel 15 includes greater than about 85% by weight of aggregate.

Referring now to FIGS. 1, 2A-2C, 3, 6, 7, and 8A-8B, the drainage system 14 may be configured to receive at least one structural member 30 and, preferably, a network of structural members 36. In some embodiments, the structural member 30 may be a reinforcing bar (referred to herein as "rebar"), and thus the network of structural members 36 may be a rebar network. Each structural member 30 has a first end 32 and second end 34 and is preferably formed of stainless steel, galvanized, or coated on the exterior with a water-resistant substance. In some embodiments, the first end 32 of a structural member 30 extends through an aperture 33 in at least one of the sidewalls 21 of the open-faced channel 15, while the second end 34 of the structural member 30 extends through an aperture 33 in at least a different one of the sidewalls 21 of the open-faced channel 15. In such embodiments, the apertures 33 matingly engage with the ends of the structural member. In a typical embodiment, a structural member 30 may extend through an aperture 33 in a first sidewall and extend through an aperture 33 in a second sidewall which is across from the first sidewall. For instance, a structural member 30 extending through an aperture 33 in the first lateral side 19 may extend through an aperture 33 in the second lateral side 20. Additionally or alternatively, a structural member 30 extending through an aperture 33 in the first end member 17 may extend through an aperture 33 in the second end member 18.

The first and second ends 32, 34 of a structural member 30 are adapted to connect to the ends of structural members 30 of a structural support located within the sidewalls of the preformed trench and may be permanently or removably attached to the apertures 33 in the sidewalls 21 of the open-faced channel 15. By connecting the open-faced channel 15 to the structural members 36 within the trench sidewalls, the open-faced channel 15 may be secured in a more stable manner when compared to conventional methods. In some embodiments, one or more of the apertures 33 may be sealed by a sealing structure such as a grommet, gasket, bushing, or the like. Said sealing structures, which serve to help reduce and/or prevent fluid leakage near the apertures 33, may preferably be made of an elastic material such as rubber, but may also be made of plastic or metal.

In some embodiments, a conduit connector 38 may be embedded within one of the sidewalls 21 or within the bottom wall 22 of the open-faced channel 15, as depicted in FIG. 2C and 8B. The conduit connector 38 can effectively connect a drainage system component, such as a conduit, which can serve as either an inlet or an outlet to the drainage system 14. Preferably, the conduit connector 38 is embedded within the bottom wall 22 of the open-faced channel 15 by being integrally molded within the material forming the open-faced channel 15 during casting. In some embodiments, the bottom wall 22 of the open-faced channel 15 may be angled downward toward the conduit connector 38 such that fluids may be channeled into the conduit connector 38 using gravity. In other embodiments, the bottom wall 22 may be substantially level.

Additionally, as shown in FIGS. 2A-2C, 3-7, and 8A-8B, the drainage system 14 may also include a trench cover 42 that is preferably supported by a support surface 40 on the upper portion of the open-faced channel 15. In such embodiments, the support surface 40 may be created by a lateral and vertical extension of the top portions of the lateral sides 19, 20, as best seen in FIGS. 1, 2A, and 7. For instance, if the trench cover 42 is in the shape of a rectangular prism, the top portions of the lateral sides 19, 20 may extend laterally at a 90 degree angle from the side wall, then vertically at a 90 degree angle from the lateral extension in order to accommodate the rectangular trench cover 42. The trench cover 42 may be arranged in a lattice configuration (e.g., a grate, grille, mesh, or the like) to permit fluids to pass therethrough while providing resistance against downward forces, such as those caused by placing an object on the top portion of trench cover 42 (e.g., a vehicle tire, a person's foot, debris, or the like). The trench cover 42 can be made from a range of materials, such as metals, polymers, carbon fiber, and the like.

As best shown in FIGS. 2B, 2C, and 4-7, the trench cover 42 preferably includes at least a first and second integrally-formed lug 46A, 46B. During installation of the trench cover 42 in the drainage system 14, the second integrally-formed lug 46B is slid under a stationary retention pin 26B that is fixed through a hole in one of the sidewalls 21 and then the first integrally-formed lug 46A is placed on the support surface 40. Next, a removable retention pin 26A is placed above the first integrally-formed lug 46A and through another hole in one of the sidewalls 21, such that a space is formed between the removable retention pin 26A and the first integrally-formed lug 46A. A removable plate 44 is then slid in the space between the removable retention pin 26A and the first integrally-formed lug 46A, creating an interference in the removal of the first integrally-formed lug 46A past the removable retention pin 26A and, in turn, facilitating retention of the trench cover 42 in the drainage system 14. The interaction between the second integrally-formed lug 46B and the stationary retention pin 26B also facilitates retention of the trench cover 42 in the drainage system 14. In some embodiments, the removable retention pin 26A and the stationary retention pin 26B each extend through a hole in one of the sidewalls 21 and interact with the curable medium 13 poured around the open-faced channel 15 to secure the open-faced channel 15 in the curable medium 13 and bear any retention weight applied to the trench cover 42.

The length of the open-faced channel 15 may be extended as needed by increasing the length of the first and second lateral sides 19, 20. As best shown in FIGS. 8A and 8B, the trench cover 42, which may be a unitarily constructed piece or a combination of multiple separate trench cover pieces, may be secured to the lengthened open-faced channel 15 by alternating sets of stationary retention pins 26B and removable retention pins 26A to interface with the integrally formed lugs 46A, 46B of the trench cover 42. In this way, the open-faced channel 15 may be configured to retain trench covers 42 even when the open-faced channel 15 is lengthened.

Referring now to FIGS. 9A-9G and 10A-10F, another embodiment of the present invention may provide a drainage system 14 comprising an open-faced channel 15 that is defined by a first and second ring member 51, 52 and a collection member 53. Each of the first and second ring members 51, 52 may comprise a pair of end members and a pair of lateral side members that can be formed integrally together or formed separately and then welded together or secured together using mechanical fasteners. Each of the first and second ring members 51, 52 may be formed such that the pair of end members and pair of lateral side members define an inner perimeter dimensioned such that the sidewalls 21 of the collection member 53 fit within the inner perimeters of the first and second ring members 51, 52. Typically, the first ring member 51 is positioned above the second ring member 52 such that when the collection member 53 is lowered into the ring members 51, 52, each ring member 51, 52 wraps fully around the collection member 53.

The collection member 53 may comprise first and second lateral sides 19, 20 and first and second end members 17, 18, which together will be referred to herein as the sidewalls 21 of the collection member 53. In a preferred embodiment, the sidewalls 21 are connected to one another in a substantially perpendicular manner at their edges to form a substantially rectangular shape. The collection member 53 may further comprise a bottom wall 22, which may be connected at the edges to the sidewalls 21 of the collection member 53 to create a floor portion of the open-faced channel 15. In this way, the sidewalls 21 and the bottom wall 22 of the collection member 53 are combined to define an interior cavity of the open-faced channel 15. In some embodiments, the sidewalls 21 and bottom wall 22 of the collection member 53 may be a part of a unitary construction. In other embodiments, the sidewalls 21 and bottom wall 22 may be individual parts that are affixed together by welding, adjustable fasteners, or the like. The bottom wall 22 may comprise a conduit connector 38 to facilitate the removal of fluids from the open-faced channel 15.

Each of the first and second ring members 51, 52 are preferably constructed using a highly durable and rust-resistant material, such as stainless steel, galvanized or coated steel, or the like. On the other hand, the collection member 53 may be constructed of cementitious and/or polymeric materials, metals, or the like. In this way, the open-faced channel 15 confers the benefit of high structural rigidity and stability provided by the strong first and second ring members 51, 52 while reducing manufacturing and/or replacement costs with respect to the collection member 53.

The collection member 53 may further be removably coupled to the first and second ring members 51, 52 when the drainage system 14 is installed into a trench. In this regard, the first and second ring members 51, 52 may each comprise one or more reinforced apertures 51A, 51B located along the perimeter of the first and second ring members 51, 52. Said apertures 51A, 51B may take the form of a cylindrical opening which is oriented perpendicularly to the first and second ring members 51, 52 in a horizontal manner; in other words, the apertures 51A, 51B provide a lateral passageway through which a structural member 30 (e.g., rebar) may pass.

The sidewalls 21 of the collection member 53 may also comprise one or more apertures 33 through which a structural member may pass. The apertures 33 of the collection member 53 may be cylindrical openings which run perpendicularly to the sidewalls 21 of the collection member 53 in a lateral fashion. In particular, the collection member 53 may comprise a first set of apertures 33A around the perimeter of the sidewalls 21 of the collection member 53. The first set of apertures 33A may correspond to the apertures 51A of the first ring member 51 such that the apertures 51A of the first ring member 51 and the first set of apertures 33A of the sidewalls 21 of the collection member 53 may be aligned, as best shown by comparing FIG. 9D with the cutaway view as seen in FIG. 9E, or by comparing FIG. 10D with the cutaway view as seen in FIG. 10E. Accordingly, the apertures 51A of the first ring member 51 and the apertures 33 of the collection member 53 are preferably formed in the same size and shape as one another, and are typically dimensioned to allow a structural member 30 to pass therethrough. In this way, the first ends 32 of a first set of structural members 30 may pass through both the apertures 51A of the first ring member 51 and the first set of apertures 33A of the collection member 53. Once the structural members 30 have passed through the first ring member 51 and the collection member 53, the first end 32 of the structural members 30 may be affixed to the open-faced channel 15. The second end 34 of the structural members 30 may then be secured to the structural members within the sidewalls of the trench, thereby securing the open-faced channel 15 to the trench and/or curable medium 13.

The collection member 53 may further comprise a second set of apertures 33B around the perimeter of the sidewalls 21 of the collection member 53 which correspond to the apertures 52A of the second ring member 52 such that the apertures 52A of the second ring member 52 and the second set of apertures 33B of the collection member 53 may be aligned. In this way, the first ends 32 of a second set of structural members 30 may pass through both the apertures 52A of the second ring member 52 and the second set of apertures 33B of the collection member 53 such that the second ring member 52, the collection member 53, and the first ends 32 of the structural members 30 may be affixed to one another. The second ends 34 of said structural members 30 may then be affixed to the structural members 30 within the sidewall of the trench. In this way, the collection member 53 may be secured by an evenly distributed array of structural members 30.

In some embodiments, the first ring member 51 may additionally provide a support surface 40 for installing a trench cover 42, as best seen in FIGS. 9A, 9F, 9G, 10A, and 10F. Said support surface 40 may be formed by creating a lateral extension of the top portion of the first ring member 51, then creating a vertical extension from the lateral extension such that a rectangular recess is formed by the top portion of the first ring member 51. In this way, the rectangular recess forms a seat and/or frame that is dimensioned to accept a trench cover 42.

As best shown in FIGS. 9A-9G, in some embodiments, the reinforced apertures 51A of the first ring member 51 may be positioned in an offset manner in relation to the reinforced apertures 52A of the second ring member 52, such that the reinforced apertures 51A, 52A of the first and second ring members 51, 52 are placed in a staggered configuration. In such a configuration, the apertures 51A of the first ring member 51 are not vertically aligned with the apertures 52A of the second ring member 52. In this way, when the structural members 30 are inserted into the first and second ring members 51, 52 and the collection member 53, the potential load on the drainage system 14 may be more evenly distributed.

As best shown in FIGS. 10A-10F, in other embodiments, the apertures 51A, 52A of the first and second ring members 51, 52 may be positioned in a stacked configuration such that the apertures 51A of the first ring member 51 are vertically aligned with the apertures 52A of the second ring member 52. Such a configuration may be seen when the first and second ring members 51, 52 have identical structures, as best seen in FIGS. 10C and 10D. In this way, the cost of manufacturing the first and second ring members 51, 52 may be reduced.

Referring now to FIGS. 11A-11D, another embodiment of the present invention may provide a drainage system 14 comprising an open-faced channel 15 formed from first and second lateral sides 19, 20 and first and second end members 17, 18 which collectively make up the sidewalls 21 of the open-faced channel 15. The open-faced channel 15 may further comprise a bottom wall 22 which may in turn comprise a conduit connector 38 or drainage port configured to receive a drainage pipe. The bottom wall 22 may be coupled with the sidewalls 21 in a substantially perpendicular manner to define the open-faced channel 15 to substantially resemble an open-topped rectangular prism. In some embodiments, the bottom wall 22 is coupled to the sidewalls 21 such that the bottom wall 22 is substantially level. In such embodiments, the top edges and bottom edges of the sidewalls 21 may be substantially parallel to each other.

As best seen in FIG. 11D, in other embodiments, the bottom wall 22 may be angled in the direction of the conduit connector 38 to facilitate the drainage of fluids entering the open-faced channel 15. In such embodiments, the top edges of the first and second lateral sides 19, 20 may be substantially level while the bottom edges of the first and second lateral sides 19, 20 may be slanted at an angle in the direction of the conduit connector 38. In addition, the height of the first end member 17 may be longer than the height of the second end member 18, or vice versa, according to the direction in which the bottom wall 22 and the bottom edges of the first and second lateral sides 19, 20 are angled.

The sidewalls 21 of the open-faced channel 15 may comprise one or more reinforced apertures 33 distributed laterally around the perimeter of the sidewalls 21 the open-faced channel 15. Each reinforced aperture 33 may be located in the body of the sidewalls 21 and take the form of a cylindrical opening which is oriented perpendicularly to the sidewalls 21. In this way, the reinforced apertures 33 are configured to receive structural members 30 (e.g., rebar) into the interior of the open-faced channel 15. Once the first ends 32 of the structural members 30 have been inserted into the reinforced apertures 33, the first ends 32 of the structural members 30 may be secured to the sidewalls 21, and the second ends 34 of the structural members 30 may be secured to the structural members and/or structural member network 36 within the sidewall of the trench. In some embodiments, as best seen in FIGS. 11A, 11C, and 11D, the reinforced apertures 33 may further comprise pipe-to-pipe sleeves which may extend outward laterally from the outer surfaces of the sidewalls 21 of the open-faced channel 15, which may further assist in securing the structural members 30 to the open-faced channel 15. In addition, the reinforced apertures 33 may comprise a sealing member such as a gasket, grommet, or the like, in order to prevent the leakage of fluids outside of the open-faced channel 15.

In some embodiments, the open-faced channel 15 may be configured to accept a trench cover 42 to prevent foreign objects (e.g., non-liquid matter such as leaves, garbage, or the like) from entering open-faced channel. In such embodiments, the top portions of the first and second lateral sides 19, 20 may comprise an outward lateral extension from the top edges of the first and second lateral sides 19, 20 and an upward vertical extension from the edges of the outward lateral extension, as best seen in FIG. 11A. In this way, the extensions may create a support surface 40 upon which a trench cover 42 may be placed.

In some embodiments, the open-faced channel 15 may further comprise one or more coupling members 60 that may be located proximate to the top portions of the sidewalls 21. Each coupling member 60 may comprise an anchor portion 60A combined with a hollow portion 60B, where the hollow portion 60B may be affixed to the anchor portion 60A at a 45-degree angle. In a preferred embodiment, the coupling members 60 may be inserted upward and diagonally (e.g., at a 45-degree angle upward from parallel) into openings (e.g., holes 62) located near the top of the first and second lateral sides 19, 20, such that the anchor portion 60A is oriented vertically from parallel and the hollow portion 60B is oriented upwards and diagonally into the open-faced channel 15. For instance, as seen in FIG. 11A, the coupling members 60 may be inserted diagonally upward into a hole 62 located along the corner created by the lateral extension and vertical extension of the first and second lateral sides 19, 20. The coupling members 60 may be then affixed to the first and second lateral sides 19, 20 such that when a curable medium 13 is poured to surround the open-faced channel 15 to a level that is above the coupling members 60, the open-faced channel 15 may be anchored to the curable medium 13 via the anchor portions 60A of the coupling members 60.

In some embodiments, the hollow portions 60B of the coupling members 60 may be configured to receive a removable retaining pin 61. For instance, if the hollow portion 60B of the coupling member 60 is cylindrical, then the removable retaining pin 61 may be a cylinder dimensioned to fit within the interior of the hollow portion 60B of the coupling member 60. Once the removable pin 61 is inserted into the hollow portion 60B of the coupling member 60, the removable pin 61 may provide a mechanism by which to secure the open-faced channel 15 within the trench by resisting any upward movements of the open-faced channel 15. In embodiments in which the open-faced channel 15 comprises a trench cover 42, the removable pin 61 may be inserted after the trench cover 42 is placed onto the support surface 40 of the first and second lateral sides 19, 20. In such embodiments, the removable pin 61 may be positioned above an integrally-formed lug of the trench cover 42 such that the removable pin 61 resists the upward movement of the trench cover 42.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation. In addition, where possible, any terms expressed in the singular form herein are meant to also include the plural form and/or vice versa. As used herein, "at least one" shall mean "one or more" and these phrases are intended to be interchangeable. Accordingly, the terms "a" and/or "an" shall mean "at least one" or "one or more," even though the phrase "one or more" or "at least one" is also used herein.

That which is claimed:

1. A drainage system that is structured to be fixedly embedded within a curable medium having a structural support comprising a plurality of structural members, the drainage system comprising:

an open-faced channel having a first and second lateral side and a first and second end member, wherein the first end member is attached to one end of the first and second lateral sides, the second end member is attached to the opposing end of the first and second lateral sides, and the first and second lateral sides and the first and second end members are spaced apart by a predetermined distance to define an interior space therebetween, wherein each one of said first lateral side, second lateral side, first end member, and second end member defines an aperture structured to matingly engage one of the plurality of structural members to thereby tie the drainage system into the structural support for the curable medium, wherein the aperture of the first lateral side is structured to allow a first end of a first structural member of the plurality of structural members to extend through the aperture of the first lateral side, wherein the aperture of the second lateral side is structured to allow a second end of the first structural member to extend through the aperture of the second lateral side, wherein the aperture of the first end member is structured to allow a first end of a second structural member of the plurality of structural members to extend through the aperture in first end member, wherein the aperture of the second end member is structured to allow a second end of the second structural member to extend through the aperture in the second end member.

2. The drainage system according to claim 1, wherein the drainage system further comprises a support surface for a trench cover, wherein the support surface is defined longitudinally by an upper side edge of the first lateral side and an upper side edge of the second lateral side.

3. The drainage system according to claim 2, wherein the drainage system further comprises a stationary retention pin placed within a first hole in at least one of the first and second lateral sides and the first and second end members, wherein the stationary retention pin is configured to retain a first integrally-formed lug of the trench cover, wherein the drainage system further comprises a removable retention pin placed within a second hole in at least one of the first and second lateral sides and the first and second end members, wherein the removable retention pin creates a space between the removable retention pin and a second integrally-formed lug of the trench cover, wherein the drainage system further comprises a removable plate configured to occupy the space between the removable retention pin and the second integrally-formed lug of the trench cover to facilitate retention of the trench cover.

4. The drainage system according to claim 1, wherein the open-faced channel further comprises a bottom wall attached to a bottom end of the first and second lateral sides and a bottom end of the first and second end members, wherein the bottom wall comprises a conduit connector configured to couple with a drainage component.

5. The drainage system according to claim 4, wherein the bottom wall is slanted at an angle toward the conduit connector.

6. The drainage system according to claim 1, wherein the first lateral side comprises an anchor flange extending along a length of the first lateral side, wherein the second lateral side comprises an anchor flange extending along a length of the second lateral side, wherein the anchor flange of the first lateral side and the anchor flange of the second lateral side are configured to retain a position of the drainage system within the curable medium.

7. The drainage system according to claim 1, wherein the open-faced channel further comprises one or more installation legs that are removably attached to the open-faced channel, wherein the installation legs are configured to secure the open-faced channel within the curable medium.

8. The drainage system according to claim 1, wherein the open-faced channel is defined by:

a first ring member comprising at least one aperture for receiving the structural member;

a second ring member comprising at least one aperture for receiving the structural member, wherein the first ring member is positioned above the second ring member; and a collection member comprising a first set of apertures around a perimeter of the collection member, wherein the first set of apertures corresponds to the at least one aperture of the first ring member, wherein the collection member further comprises a second set of apertures around the perimeter of the collection member, wherein the second set of apertures corresponds to the at least one aperture of the second ring member, wherein the first set of apertures are located above the second set of apertures, wherein the collection member is configured to be removably coupled to the first ring member by inserting a first structural member through the at least one aperture of the first ring member and an aperture of the first set of apertures, and by inserting a second structural member through the at least one aperture of the second ring member and an aperture of the second set of apertures.

9. The drainage system according to claim 8, wherein the at least one aperture of the first ring member and the at least one aperture of the second ring member are in a staggered configuration such that the at least one aperture of the first ring member and the at least one aperture of the second ring member are not vertically aligned.

10. The drainage system according to claim 8, wherein the at least one aperture of the first ring member and the at least one aperture of the second ring member are in a stacked configuration such that the at least one aperture of the first ring member and the at least one aperture of the second ring member are vertically aligned.

11. The drainage system according to claim 1, wherein the open-faced channel comprises one or more reinforced apertures distributed laterally around a perimeter of the open-faced channel, wherein each one of the one or more reinforced apertures is a cylindrically-shaped opening oriented perpendicularly to the perimeter of the open-faced channel.

12. The drainage system according to claim 11, further comprising at least one coupling member positioned proximate to a top portion of at least one of the first and second lateral sides and the first and second end members, wherein the coupling member comprises a diagonally oriented hollow portion configured to accept a removable retention pin, wherein the removable retention pin is configured to secure the open-faced channel within a curable medium.

13. The drainage system according to claim 12, wherein the removable retention pin is positioned above an integrally-formed lug of a trench cover to facilitate retention of the trench cover.

14. A method of installing a drainage system, the method comprising:

providing an open-faced channel having a first and second lateral side and a first and second end member, wherein the first end member is attached to one end of the first and second lateral sides, the second end member is attached to the opposing end of the first and second lateral sides, and the first and second lateral sides and the first and second end members are spaced apart by a predetermined distance to define an interior space therebetween;

providing a first structural member having a first and second end, wherein the first end of the first structural member extends through an aperture in the first end member, and the second end of the first structural member extends through an aperture in the second end member;

providing a second structural member having a first and second end, wherein the first end of the second structural member extends through an aperture in the first lateral side, and the second end of the second structural member extends through an aperture in the second lateral side;

positioning the drainage system in a trench, wherein the trench comprises at least two sidewalls that each contain at least one structural member having an end; and securing the first end of the at least one structural member of the drainage system to an end of the structural member in one of the at least two sidewalls of the trench.

15. A method of manufacturing a drainage system that is structured to be fixedly embedded within a curable medium having a structural support comprising a plurality of structural members, the method comprising:

providing an open-faced channel having a first and second lateral side and a first and second end member, wherein the first end member is attached to one end of the first and second lateral sides, the second end member is attached to the opposing end of the first and second lateral sides, and the first and second lateral sides and first and second end members are spaced apart by a predetermined distance to define an interior space therebetween, wherein each one of said first lateral side, second lateral side, first end member, and second end member define an aperture structured to matingly engage one of the plurality of structural members to thereby tie the drainage system into the structural support for the curable medium, wherein the aperture of the first lateral side is structured to allow a first end of a first structural member of the plurality of structural members to extend through the aperture the first lateral side, wherein the aperture of the second lateral side is structured to allow a second end of the first structural member to extend through the aperture of the second lateral side, wherein the aperture of the first end member is structured to allow a first end of a second structural member of the plurality of structural members to extend through the aperture in first end member, wherein the aperture of the second end member is structured to allow a second end of the second structural member to extend through the aperture in the second end member.

* * * * *